US005599781A

United States Patent [19]

Haeggberg et al.

[11] Patent Number: 5,599,781

[45] Date of Patent: Feb. 4, 1997

[54] AUTOMATIC DISHWASHING DETERGENT HAVING BLEACH SYSTEM COMPRISING MONOPERSULFATE, CATIONIC BLEACH ACTIVATOR AND PERBORATE OR PERCARBONATE

[76] Inventors: Donna J. Haeggberg; Lucille F. Taylor; Mark R. Sivik; James C. T. R. Burckett-St. Laurent, all of The Procter & Gamble Company, Miami Valley Laboratories P.O. Box 538707, Cincinnati, Ohio 45253-8707

[21] Appl. No.: 508,196

[22] Filed: Jul. 27, 1995

[51] Int. Cl.[6] ..... C11D 3/28; C11D 3/395; C11D 7/54; C11D 17/06; D06L 3/02

[52] U.S. Cl. ..... 510/220; 510/224; 510/367; 510/374; 510/376; 510/378; 510/446; 510/466; 510/475; 510/500; 510/504; 510/509; 252/186.38; 252/186.39; 252/186.42; 252/186.43; 134/25.2

[58] Field of Search ..... 252/102, 186.38, 252/186.42, 186.43, 186.39, 95, 97, 99, 135, 174.12, 174.25, 174.23, 524, 542, 174.21; 134/25.2

[56] References Cited

U.S. PATENT DOCUMENTS

| | | | |
|---|---|---|---|
| 3,049,495 | 8/1962 | Jenkins et al. | 252/102 |
| 3,556,711 | 1/1971 | Stalter | 8/111 |
| 3,558,497 | 1/1971 | Lawes | 252/99 |
| 3,732,170 | 5/1973 | Ermont | 252/95 |
| 3,805,809 | 4/1974 | Zeffren et al. | 132/7 |
| 3,819,828 | 6/1974 | McCoy | 424/71 |
| 3,945,937 | 3/1976 | Villaume | 252/102 |
| 3,959,461 | 5/1976 | Bailey et al. | 424/70 |
| 4,127,496 | 11/1978 | Stokes | 252/102 |
| 4,260,529 | 4/1981 | Letton | 252/547 |
| 4,377,489 | 3/1983 | King | 252/99 |
| 4,397,757 | 8/1983 | Bright et al. | 252/186.41 |
| 4,412,934 | 11/1983 | Chung et al. | 252/186.38 |
| 4,536,314 | 8/1985 | Hardy et al. | 252/102 |
| 4,568,476 | 2/1986 | Kielman et al. | 252/95 |
| 4,681,592 | 7/1987 | Hardy et al. | 8/111 |
| 4,751,015 | 6/1988 | Humphreys et al. | 252/99 |
| 4,818,426 | 4/1989 | Humphreys et al. | 252/99 |
| 4,904,406 | 2/1990 | Darwent et al. | 252/102 |
| 4,933,103 | 6/1990 | Aoyagi et al. | 252/186.38 |
| 4,988,451 | 1/1991 | Nunn et al. | 252/95 |
| 4,988,817 | 1/1991 | Madison et al. | 546/222 |
| 5,041,232 | 8/1991 | Batal et al. | 252/94 |
| 5,045,223 | 9/1991 | Batal et al. | 252/102 |
| 5,047,163 | 9/1991 | Batal et al. | 252/102 |
| 5,047,577 | 9/1991 | Smith et al. | 560/253 |
| 5,089,162 | 2/1992 | Rapisarda et al. | 252/102 |
| 5,093,022 | 3/1992 | Sotoya et al. | 252/102 |
| 5,106,528 | 4/1992 | Francis et al. | 252/186.23 |
| 5,143,641 | 9/1992 | Nunn | 252/186.38 |
| 5,152,910 | 10/1992 | Savio et al. | 252/95 |
| 5,220,051 | 6/1993 | Sotoya et al. | 560/142 |
| 5,240,632 | 8/1993 | Brumbaugh | 252/95 |
| 5,246,612 | 9/1993 | Van Dijk et al. | 252/102 |
| 5,330,677 | 7/1994 | Sotoya et al. | 252/186.38 |
| 5,338,491 | 8/1994 | Connor et al. | 252/548 |
| 5,384,062 | 1/1995 | Eoga et al. | 252/99 |
| 5,399,746 | 3/1995 | Steiger et al. | 560/251 |
| 5,405,412 | 4/1995 | Willey et al. | 8/111 |
| 5,405,413 | 4/1995 | Willey et al. | 8/111 |
| 5,458,801 | 10/1995 | Oyashiki et al. | 252/186.25 |
| 5,460,747 | 10/1995 | Gosselink et al. | 252/186.38 |
| 5,503,639 | 4/1996 | Willey et al. | 8/111 |

FOREIGN PATENT DOCUMENTS

| | | | |
|---|---|---|---|
| 0272030 | 6/1988 | European Pat. Off. . | |
| 400858 | 12/1990 | European Pat. Off. | A61K 7/20 |
| 0427224 | 5/1991 | European Pat. Off. . | |
| 0464880 | 1/1992 | European Pat. Off. . | |
| 512533 | 11/1992 | European Pat. Off. | C11D 3/39 |
| 540090 | 5/1993 | European Pat. Off. | C11D 17/00 |
| 58-180420 | 10/1983 | Japan | A61K 7/30 |
| 1198700 | 8/1989 | Japan . | |
| 2-011545 | 1/1990 | Japan . | |
| 2-115154 | 4/1990 | Japan . | |
| 2132195 | 5/1990 | Japan . | |
| WO93/18129 | 9/1993 | WIPO | C11D 3/39 |
| 9529160 | 11/1995 | WIPO . | |

OTHER PUBLICATIONS

Pillersdorf et al., "Dipolar Micelles 9. The Mechanism of Hydrolysis of Cationic Long Chained Benzoate Esters in Choline and Homocholine-type Micelles", Israel Journal of Chemistry, vol. 18 (Jun. 14, 1979) pp. 330–338.

Farr et al., "Bleaching Agents", Kirk Othmer, Encyclopedia of Chemical Technology, 4th. Ed., vol. 4, pp. 271–300 (1992).

*Primary Examiner*—Paul Lieberman
*Assistant Examiner*—Lorna M. Douyon
*Attorney, Agent, or Firm*—Kim William Zerby; Jerry J. Yetter; Jacobus C. Rasser

[57] ABSTRACT

Detergents, especially automatic dishwashing detergents, comprising a stain removal system especially adapted for removal of tea stains, coffee stains and the like. The compositions comprise monopersulfate bleach such as $2KHSO_5 \cdot KHSO_4 \cdot K_2SO_4$ in combination with perborate or percarbonate at specific ratios, in combination with certain cationic or quaternary-substituted bleach activators.

19 Claims, No Drawings

AUTOMATIC DISHWASHING DETERGENT HAVING BLEACH SYSTEM COMPRISING MONOPERSULFATE, CATIONIC BLEACH ACTIVATOR AND PERBORATE OR PERCARBONATE

TECHNICAL FIELD

The present invention is in the detergent field. It relates especially to automatic dishwashing detergents (ADD's) with oxygen bleach, though other detergents and cleaning products, such as "soak" type cleaning compositions for stain removal from tea and coffee-pots are also included. The detergents herein can be liquids, pastes, or solids such as tablets, and especially granules. Methods for cleaning are encompassed.

BACKGROUND OF THE INVENTION

Automatic dishwashing detergents for use in domestic dishwashing appliances need to be able to effectively remove stains of foods and beverages, especially tea and coffee, from household dishware. Heretofore, alkaline products containing chlorine bleach have typically been used for this purpose. Many such products also use high (20% or more) levels of phosphate builders. It is desirable, however, to replace such chlorine bleach-reliant automatic dishwashing product systems with effective alternatives. Reasons include: minimizing the aggressive effect of chlorine bleach and alkalis on valuable consumer items such as silverware, china and crystal; increasing the compatibility of bleach ingredients with other excellent cleaning agents, particularly enzymes; maximizing product safety; and complying with regulatory requirements in different geographies.

Oxygen bleach, specifically perborate in combination with the bleach activator tetraacetylethylenediamine (TAED), has been introduced commercially as a chlorine bleach replacement in certain automatic dishwashing products. However, testing demonstrates that, with or without the TAED component, this bleach system is very poor in its effectiveness, even when used at much higher levels than a chlorine system, on a mass basis.

Persulfates have also been proposed as an alternative bleach. A number of persulfates exist, including potassium peroxydisulfate and monopersulfate salts. The latter, in general, are salts derived from Caro's acid or monopersulfuric acid, $H_2SO_5$. Monopersulfate salts, such as the potassium, sodium, and magnesium salts, as well as binary and ternary mixed salts of monopersulfate with alkali metal sulfates and/or bisulfates, are generally known from the literature. One such salt, sold commercially as OXONE® (registered trademark of DuPont), has been variously described as a mixture of potassium monopersulfate with potassium sulfate and potassium bisulfate, or as a "triple salt" having specific stoichiometry.

Monopersulfate salts are chemically different from peroxydisulfate salts, such as potassium peroxydisulfate, $K_2S_2O_8$. Indeed, peroxydisulfate alone is not effective in the instant invention. Despite some success in denture cleaners, monopersulfate bleach has not been commercially successful in dishwashing detergents any more than has peroxydisulfate. Yet it would be very desirable to use a persulfate bleach in automatic dishwashing, on account of good redox properties and the environmental acceptability (no chlorine, phosphorus, or boron) of persulfate decomposition products (e.g., sulfate, oxygen).

Possible reasons for the lack of widespread use of persulfate in automatic dishwashing include: lack of mass efficiency, particularly for the OXONE form; and slow action (kinetics) under automatic dishwashing conditions as compared with chlorine bleach. Nonetheless, some progress has been made in formulating OXONE in automatic dishwashing detergents. See commonly assigned WO 93/18129 as well as the documents included in the section entitled "Background Art".

A number of systems have been described in the art for promoting more effective bleaching, especially by perborate or percarbonate salts. For example, various efforts have been made to improve the efficacy of bleach activators and hundreds of such activators have been described. Reasons for the lack of commercially successful improvements may include an emphasis on laundry improvements not easily adaptable for automatic dishwashing. Bleach activators may, for example, yield unacceptably depositing, foam-forming or malodorous peracids, none of which are acceptable for automatic dishwashing, especially in a spray-action domestic dishwasher. There has been little teaching in the art as to which of the now so numerous bleach activators would be problem-free, and at the same time more effective than TAED, in the unique automatic dishwashing context.

The disclosure of many bleach activators in the context of laundry formulations includes the suggestion that quaternary-substituted versions of such activators may be of a depositing nature and have desirable fabric conditioning properties. See, for example, U.S. Pat. No. 4,751,015 at col. 3, lines 22–27. In light of this teaching and in view of the conventionally recognized need to minimize deposition tendencies of ingredients in automatic dishwashing, the automatic dishwashing detergent formulator would be inclined to avoid such bleach activators. This patent as well as U.S. Pat. Nos. 4,904,406 and 4,818,426 are illustrative of disclosures of bleach activators which may include chemical groups which may be cationic and/or which may form peroxy-carbonic acids when perhydrolyzed.

Metal-containing bleaching action "accelerators" or catalysts have also been described in the literature. Thus, automatic dishwashing detergents containing oxygen bleach with a manganese catalyst are known. See U.S. Pat. No. 5,246,612. Typically, such systems use a combination of manganese catalyst with sodium perborate, optionally with a bleach activator such as TAED. See the examples of '612.

Further, U.S. Pat. No. 5,246,612 recites, under the heading "peroxygen compound", a list of "hydrogen peroxide sources". Perborates, percarbonates, perphosphates and persulfates (without specifying whether monopersulfates, dipersulfates or both are intended) are included in this list. It is, in fact, technically incorrect to term a monopersulfate a "hydrogen peroxide source": under common detergency conditions, monopersulfate salts are not a source of hydrogen peroxide. There is no indication in '612 that any specific mixture of persulfates and perborates should be used in combination with catalyst or any of certain specific bleach activators disclosed hereinafter.

All the foregoing developments notwithstanding, there is an ongoing need for improved oxygen bleach detergents, especially automatic dishwashing detergents. In short, bleach activators tend to be expensive and may not be compatible with automatic dishwashing while persulfates, perborate and percarbonate all are slow-acting or ineffective, even when combined with common bleach activators. Moreover, transition-metal bleach catalysts may in some circumstances decompose and leave residues on dishware, thus, even the "bleach catalyst" approach is not without its limitations.

Accordingly it is an object herein to provide an improved oxygen bleach detergent, especially an automatic dishwashing detergent or a soak-type tea-pot cleaner, having an effective multicomponent oxygen bleach system which overcomes one or more of the disadvantages of the art-taught combinations of oxygen bleach ingredients.

It has now surprisingly been discovered that efficient and economical compositions for removal of beverage stains such as tea and coffee from substrates including, but not limited to, ceramics, porcelain and the like are secured from a particular combination of monopersulfate bleach and hydrogen peroxide-releasing bleach at specific ratios, provided that there is also present a cationic bleach activator. Most generally, the cationic bleach activator includes any of the known cationically charged (typically, quaternary nitrogen-containing) bleach activators hitherto recognized for use in combination with sodium perborate. Any of the cationic bleach activators identified hereinafter can be useful herein.

The present invention has multiple advantages, including making monopersulfate more useful, especially at reduced levels, to the automatic dishwashing detergent formulator; rendering the use of chlorine bleach unneccessary; improving tea stain removal over that attainable using perborate/TAED; and providing for the consumer dishwashing detergents having an excellent overall combination of tea stain removal, dishcare, and cleaning. The compositions are more enzyme-compatible than those hitherto formulated with monopersulfate.

BACKGROUND ART

As noted hereinbefore, OXONE in automatic dishwashing is described in commonly assigned WO 93/18129, Hartman et al, published Sep. 16, 1993; and quaternary or cationic bleach activators are described in U.S. Pat. Nos. 4,751,015, 4,818,426 and 4,904,406; 5,246,612 describes manganese bleach catalysts in automatic dishwashing.

More generally, bleaching agents, including numerous patent references thereto, are reviewed by J. P Farr et al of the Clorox Co., in Kirk Othmer, Encyclopedia of Chemical Technology, 4th. Edition, Vol. 4, pages 271–300, published 1992 by John Wiley & Sons Inc.

U.S. Pat. No. 5,384,062, Eoga et al, issued Jan. 24, 1995, and many other patents, describe denture cleansing tablets. Eoga et al '062 describes denture cleansing advantages attributable to a mixture of perborate and monopersulfate. Automatic dishwashing is of course typically carried out under quite different temperature/time/mechanical agitation conditions than denture cleansing, and is considered and classified as a separate art.

Additional documents pertaining to the use of monopersulfate salts such as OXONE include: U.S. Pat. Nos. 3,049,495; 3,556,711; 3,558,497; 3,732,170; 3,805,809; 3,819,828; 3,945,937; 4,127,496; 5,041,232; 5,045,223; 5,047,163; European Patent Applications EP-A 135,226; and EP-A 400,858; Japanese JP 58180420 A2; and South African ZA 8,301,869. Persulfates are also mentioned in U.S. Pat. No. 5,089,162, Rapisarda et al, issued Feb. 18, 1992 which relates to bleach-stable colorants; and in U.S. Pat. No. 5,152,910, Savio et al, issued Oct. 6, 1992 which relates to automatic dishwashing detergent formulation of carbonate salts. Another automatic dishwashing detergent with optional inclusion of persulfates is described in EP-A 239,379.

Among the many disclosures of "cationic", "quaternary" or "amphoteric" bleach activators, especially those used in fabric laundering, are the following: EP 120,591 A1 published Mar. 10, 1984 describes a bleach activator having the structure RC(O)L wherein RC(O) is a particular acyl moiety and L is a leaving-group. It is disclosed that a quaternary nitrogen group can be included in L. Other bleach activators which can be quaternary by virtue of a cationic leaving-group are disclosed in U.S. Pat. No. 4,681,592: see col. 10, line 29 and in U.S. Pat. No. 4,412,934 and 4,536,314, all commonly assigned.

Additionally, EP 427,224 A1 and U.S. Pat. No. 5,220,051 describe laundry detergent compositions comprising polycationic compounds of the formula:

$$Z_m-X-[Y-X(Z_{m-1})]_n-Y-X-Z_m.(n+2)A$$

in which X is assertedly a "cation", Y is an alkylene, Z is a specific noncharged carbonyl-containing group and A is an anionic group. Based on the further illustrations in the disclosure, X is understood to be a cationic or quaternary nitrogen-containing moiety covalently incorporated into the structure. Moieties in the positions indicated by X appear to be the only quaternary nitrogen in these compounds.

Bleach activators have even been described which comprise a cationic moiety on each side of a perhydrolyzable acyl moiety. See, for example, U.S. Pat. No. 5,093,022, formula (I) at col. 1, line 50 with the substituent Y shown at col. 2, lines 40–45; and JP 02011545 A2 which describes the following bisquaternary compounds as textile bleaches and softeners:

$$R^1-N^+(R^2)(R^3)-(CH_2)_n-C(=O)-O-R^4-N^+(R^5)(R^6)-R^7\,2X^-$$

wherein $R^1$ and $R^7$ are $C_1$–$C_{22}$ alkyl; $R^2$, $R^3$, $R^5$ and $R^6$ are $C_1$–$C_5$ alkyl, hydroxyethyl or hydroxypropyl; $R^4$ is $C_2$–$C_3$ alkylene; n is from 1 to 5 and X is an anion. Additional cationic or quaternary activators, including diquaternary or dicationic types, are described in JP 02115154.

Compounds of interest for hair cream rinse formulations, have a different kind of bisquaternary structure:

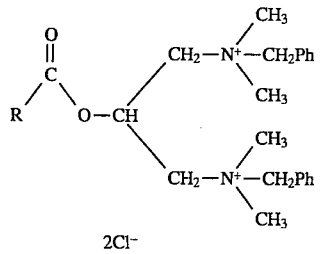

wherein R is a saturated normal alkyl group of at least 11 carbon atoms and Ph is phenyl. These are described in U.S. Pat. No. 3,959,461. Similar compounds, such as the 1,3-bis-trimethylammonium isopropyl esters of octanoic and decanoic acids, have been incorporated into laundry detergents as bleach activators. See U.S. Pat. No. 5,399,746.

For quaternary carbonate ester compounds suitable as bleach activators, see also Pillersdorf and Katzhendler, Israel J. Chem. 18, 1979, 330–338. U.S. Pat. No. 4,260,529 discloses certain unusual cationic surfactants which assertedly may be useful bleach activators.

Other known quaternary substituted bleach activators are illustrated in U.S. Pat. Nos. 5,330,677; 4,397,757; 5,047,577; 4,988,817; 4,988,451; EP 512,533 and EP 540,090.

SUMMARY OF THE INVENTION

The present invention encompasses a detergent composition comprising an effective amount of a stain (e.g., tea; coffee) removal system comprising: (a) one or more monopersulfate salts: (b) one or more hydrogen peroxide releasing salts, especially one of the commercial perborates or percarbonates; and (c) one or more cationic bleach activators.

In a highly preferred embodiment, the invention includes a detergent composition having the form of an automatic dishwashing detergent, wherein: said monopersulfate salt is $2KHSO_5 \cdot KHSO_4 \cdot K_2SO_4$; said hydrogen peroxide releasing salt is selected from the group consisting of sodium perborate, sodium percarbonate and mixtures thereof, and said cationic bleach activator is selected from the group consisting of:

(i) monocationic bleach activator having the formula: $((CH_3)_3N^+(CH_2)_{3\text{-}8}C(O)L)\ (Z)^-$ where L is caprolactam and the designation $(CH_2)_{3\text{-}8}$ indicates that from three to eight methylenes can be present and (ii) tricationic bleach activator having the formula:

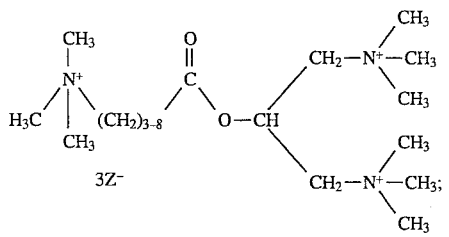

wherein $Z^-$ is a water soluble nonsoap anion, such as chloride, sulfate or p-toluenesulfonate, more preferably sulfate or p-toluenesulfonate, i.e., a nonhalide anion. More generally, while not preferred, it is possible to include a wide range of alternative singly-charged or multiply-charged anions, such as phosphate, as is disclosed more fully hereinafter. While in general, the level of monopersulfate may vary quite widely, other preferred embodiments herein include detergent compositions wherein said monopersulfate salt is present at a level of no more than about 4.9% by weight of the composition. For comparison, past efforts to formulate monopersulfate salts such as $2KHSO_5 \cdot KHSO_4 \cdot K_2SO_4$ into automatic dishwashing detergents typically require rather high levels of monopersulfate, which is undesirable both on account of formulation stability and tendency to decrease product pH to an extent which may compromise cleaning.

Another important aspect of the present invention is the discovery that, for the present purposes, it is highly desirable that said hydrogen peroxide releasing salt and said monopersulfate salt are at a ratio, on an available oxygen basis, of from about 25:1 to about 1:2, more preferably from about 10:1 to about 1.5:1.

In terms of absolute levels of ingredients, preferred embodiments of the instant compositions comprise (a) from about 0.02% to about 2.5%, on an available oxygen basis, of said monopersulfate salt; (b) from about 0.1% to about 4%, on an available oxygen basis, of said hydrogen peroxide releasing salt; and (c) from about 0.1% to about 10% by weight of said cationic bleach activator.

A range of adjunct materials can be added to the present compositions. Exceptionally important for automatic dishwashing purposes are low-foaming nonionic surfactants; moreover, specifically defined carotenoid stain removal systems can be added to the compositions, with excellent results. Such preferred compositions are illustrated by a compact granular nonphosphate automatic dishwashing detergent composition comprising:

(a) from about 1% to about 4.9%, by weight, of monopersulfate salts selected from group consisting of $2KHSO_5 \cdot KHSO_4 \cdot K_2SO_4$, potassium monopersulfate, sodium monopersulfate, magnesium monopersulfate, tetraalkylammonium monopersulfate, and mixtures thereof;

(b) from about 3% to about 15%, by weight, of sodium perborate, sodium percarbonate or mixtures thereof;

(c) from about 0.5% to about 5%, by weight, of a cationic bleach activator selected from the group consisting of:
(i) monocationic bleach activator having the formula:

$$((CH_3)_3N^+(CH_2)_5C(O)L)(Z)^-$$

where L is caprolactam and
(ii) tricationic bleach activator having the formula:

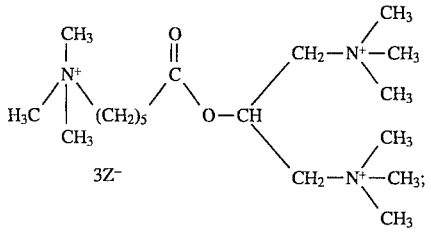

wherein in (i) or (ii) $Z^-$ is a water soluble nonhalogen nonsoap union;

(d) from 0% to about 1%, by weight, preferably from about 0.01% to about 0.5% by weight, of a Cobalt (III) bleach catalyst;

(e) from about 0.01% to about 0.5% by weight of active detersive enzyme selected from proteolytic enzymes, amyolytic enzymes and mixtures thereof, (f) from about 0.1% to about 10% by weight of a dispersant polymer;

(g) from about 5% to about 25%, by weight, of a pH adjusting agent selected from the group consisting of sodium carbonate, sodium bicarbonate, and mixtures thereof, (h) from about 4% to about 25%, by weight, of a water-soluble silicate selected from hydrous 2-ratio sodium silicates;

(i) from about 1% to about 80% by weight of citrate builder, for example trisodium citrate dihydrate;

(j) from about 0.1% to about 2% of a chelant;

(k) from about 0.1% to about 10% by weight of a low-foaming nonionic surfactant;

(l) from 0% to about 3% of a carotenoid stain removal adjunct selected from the group consisting of dibenzoyl peroxide and noncharged hydrophobic bleach activators; and (m) from 0% to about 5% of one or more material care agents;

wherein said composition is in granular form.

Desirably, especially when the compositions contain enzymes, the total soluble halide content, expressed as a sum of fluoride, chloride, and bromide, is less than about 0.5% by weight.

The present invention also encompasses a method for cleansing tableware in an automatic dishwashing machine, comprising a step of washing said tableware with an aqueous bath comprising from about 1,500 ppm to about 4,000 ppm, more preferably from about 2,000 to about 3,000 ppm of detergent composition according to the invention.

Though illustrated in preferred embodiments as an automatic dishwashing detergent, the present invention should not be considered as limited thereby. Thus, there is also encompassed a soaking detetergent composition for removal of tea or coffee stains from hard surfaces, said composition comprising the above-identified combination of monopersulfate salt, hydrogen peroxide releasing salt and cationic bleach activator, together with at least one detergent builder, filler or sequestrant.

All parts, percentages and ratios used herein are expressed as percent weight unless otherwise specified. All documents cited are, in relevant part, incorporated herein by reference.

DETAILED DESCRIPTION OF THE INVENTION

The present invention encompasses a detergent composition comprising an effective amount of a tea stain removal system.

Detergent compositions

The present compositions are detergent compositions. In general, they are useful for washing or removing stains from surfaces. Preferably, the compositions are automatic dishwashing detergent compositions. Such compositions are most useful when used in a spray-action domestic dishwashing appliance. Other types of detergent compositions include "soak-type" compositions, which can be used to treat surfaces, such as those of stained tea or coffee pots, without a dishwashing appliance. Detergent compositions can have various forms, such as powders or granules, tablets, pastes, gels and liquids (whether aqueous or non-aqueous).

The preferred detergents herein are solid-form. Granules or powders are highly preferred. Particles of solid-form detergents can, in general, have any size which is compatible with the intended use. Typical granule particles are suitably sized for good dissolution and, when multiple types of particles are admixed, particles are preferably matched in terms of size, shape and density to minimize segregation in the box. Particles may be homogeneous and/or may be made up of different ingredients. They may be coated or uncoated.

Effective Amount

While specific amounts are illustrated in detail hereinafter, an "effective amount" of any essential ingredient or combination thereof herein is any amount provided in the composition which is capable of measurably improving cleaning or stain removal (especially of soiled dishware or other surfaces) compared to the results which would be obtained using an otherwise identical composition lacking the ingredient or combination referred to.

Tea Stain Removal System

A "tea stain removal system" relates to those ingredients in a detergent composition which are primarily responsible for bleaching hydrophilic stains, especially of tea, coffee or other colored beverages. This "system" in accordance with the present invention has three essential components: a monopersulfate salt, a hydrogen peroxide releasing salt, and a cationic bleach activator. An "effective amount" of a "tea stain removal system" is an amount which is capable of measurably improving tea stain removal from a porcelain surface or other dishware when it is washed by the consumer in a domestic automatic dishwasher using the composition in the presence of alkali. By definition, other bleaching materials which are not effective for tea stain removal are not part of the tea stain removal system, though they may be included herein as optional adjuncts. Thus, hydrophobic diaryl peroxides such as dibenzoyl peroxide, and non-charged hydrophobic bleach activators such as nonanoyloxybenzenesulfonate which are effective in hydrophobic stain removal, are not part of the tea stain removal systems herein but may nonetheless be added to the automatic dishwashing product to assist removal of hydrophobic, e.g., carotenoid, stains.

Monopersulfate Salt

Monopersulfate salts are useful herein at levels given hereinabove in summary. Monopersulfate salts (MPS bleach) employed herein comprise compounds which dissociate in water to provide monopersulfate species such as $HSO_5^-$ or the corresponding dianion or radical anions. Such salts are illustrated by potassium monopersulfate, sodium monopersulfate, magnesium monopersulfate, and tetraalkylammonium monopersulfates such as tetrabutylammonium monopersulfate.

A long-known and readily commercially available monopersulfate salt employed herein is a "triple salt". Commercial compositions comprising this salt are available under the tradename OXONE, from DuPont. OXONE has the Chemical Abstracts Registry Number 37222-66-5 and is in the form of a stable, free-flowing powder which comprises $2KHSO_5.K_2SO_4.KHSO_4$. Since this salt is the most readily available, it is used in many preferred embodiments of this invention. The lower molecular weight (and thus more mass-efficient) MPS salts are desirably used for low-dosage ADD compositions of the invention, but these salts are not commonly available in bulk, and must be made by conventional literature methods.

Chemical practitioners will of course be aware that cations accompanying the monopersulfate can conveniently be exchanged by metathesis. Yet another approach is to ship bulk liquid stock of a solution of sodium or potassium monopersulfate, and, subject to the normal safety procedures for oxidants of this general type, dry or otherwise convert it adjacent the ADD manufacturing facility to whatsoever convenient solid form is desired.

In more detail, the present compositions include those comprising a persulfate salt selected from the group consisting of monopersulfates with any compatible cation. Compatible cations are typically (i) alkali metal cations, for example, sodium or potassium; (ii) alkaline earth cations, for example calcium or magnesium; (iii) quaternary ammonium cations, for example tetraalkylammonium; or (iv) cations which themselves contain a bleach-functional material, such as cations comprising a peroxycarboxylic acid, a ketone, or an acyl moiety.

Persulfates of the peroxydisulfate type are surprisingly ineffective herein. Without intending to be limited by theory, the problem with the peroxydisulfates is that, if used in the instant compositions, they are too slow-acting to be useful on the timescale of a wash in a typical automatic dishwashing appliance. Moreover, surprisingly, their effectiveness is not improved by the cationic bleach activator component. Thus the present invention in no manner involves the mere recital of a catalog of known persulfates, but rather, the careful selection of those useful and amenable to improvement by the present invention.

Preferred monopersulfates herein are selected from the group consisting of sodium monopersulfate, potassium monopersulfate, calcium monopersulfate, magnesium monopersulfate, tetralkylammonium monopersulfate, monopersulfate salts of cationic percarboxylic acids, complex monopersulfate salts such as OXONE, and mixtures thereof. More highly preferred by way of monopersulfate salt is a member selected from the group consisting of OXONE, tetraalkylammonium monopersulfate, monopersulfate salts of cationic percarboxylic acids, and alkaline earth monopersulfates.

Monopersulfate salts of cationic percarboxylic acids are further illustrated in EP 373613 B1 and U.S. Pat. No. 5,108,648 incorporated by reference, which describe pyridine-3-percarboxylic acid monopersulfate; and by the nitrogen-containing heterocyclic peroxycarboxylic acids of U.S. Pat. Nos. 5,268,472 and 5,117,049, both also incorporated by reference.

Tetralkylammonium monopersulfates are further illustrated by B. M. Trost and R. Braslau, J. Org. Chem. 1988, 53, 532–537, incorporated by reference, which discloses an impure form of tetrabutylammonium monopersulfate which is useful herein. Likewise useful are tetralkylammonium monopersulfates which have been purified, for example crude tetrabutylammonium monopersulfate or "tetrabutylammonium oxone" can be separated from potassium sulfate impurity by recrystallization from methylene chloride.

Other tetraalkylammonium monopersulfates suitable herein are those having the formula $R^1R^2R^3R^4N{+}HSO_5^-$ wherein any of $R^1$–$R^4$ is a C1–C18 hydrocarbyl, preferably alkyl, benzyl or hydroxyalkyl. Preferred among said tetralkylammonium monopersulfates are the tetramethylammonium, tetraethylammonium, tetrapropylammonium, tetrabutyl-ammonium, dimethyldibenzylammonium, textrahexylammonium, and dimethyldioctylammonium monopersulfates, though this illustration should not be considered as limiting. U.S. Pat. No. 3,353,902, incorporated by reference, further illustrates quaternary ammonium monopersulfates useful herein, as illustrated by dimethyl dihydrogenated tallow ammonium monoperoxysulfate (see Example 2 of '902). Surprisingly, none of the peroxydisulfate salts illustrated in the same patent is suitable for use herein.

Further, by way of the known versions and types of monopersulfate, the products of the methods of U.S. Pat. Nos. 3,041,139 and 3,927,189, incorporated by reference, are generally suitable for use herein, though the preferred monopersulfates are those which are relatively high in stability, more preferably still are also relatively low in hygroscopicity, as may be ascertained from the various storage stability tables in U.S. Pat. No. 3,041,139.

Units

All percentages, ratios and proportions herein are by weight, unless otherwise noted. When percentages are quoted without any particular indication as to whether the ADD compositions, their aqueous solutions at usage level, or percentages of components such as water in raw materials are intended, such percentages should be taken to refer to percentages by weight of the fully-formulated automatic dishwashing detergent. The abbreviation "ppm" refers to "parts by million". One ppm equals one milligram per liter. When "ppm" is used without indicating whether the ADD compositions or their aqueous solutions are intended, "ppm" should be taken to refer to usage-level parts by million of the indicated ingredient or composition in wash water.

Available Oxygen (Monopersulfate):

"Available Oxygen" as defined herein when referring to monopersulfate salts refers to percentage by weight of titratable O (not $O_2$), inclusive only of titratable O from monopersulfate salts and specifically exclusive of titratable O from any active hydrogen peroxide source which may be used. Titration may be done using any convenient literature method for the determination of MPS bleaches, such as iodometric methods. See, for example, Skoog and West, Fundamentals of Analytical Chemistry, Holt, Rinehart, 1976, pages 362–369 and 748–751 or supplier data sheets obtainable from the following monopersulfate suppliers: Du Pont, Degussa, and Solvay-Interox.

Conversion between Available Oxygen (AvO) and percentage of monopersulfate salt in any given composition is illustrated in the case of the pure monopersulfate triple salt $2KHSO_5.KHSO_4.K_2SO_4$ as follows:

triple salt molecular weight=614.74 g/mol;

mass fraction of Active Oxygen in pure triple salt=32/614.74; where 32 corresponds with two moles of Available O per mole of the triple salt in accordance with the presence of two moles of potassium monopersulfate in the triple salt formula;

Percentage of Available Oxygen in the pure triple salt=(32/614.74)*100=5.21% AvO.

Let us say, for example, that a given ADD composition containing only monopersulfate salts has a percentage of Available Oxygen of 0.78%

Then the percentage by weight of monopersulfate triple salt that it contains, assuming the salt is pure, is given by: 0.78/0.0521=14.97%

Similar conversions apply to any other composition in accordance with the invention, requiring only that the appropriate molecular weight of the monopersulfate salt be used. It will naturally be appreciated that commercial-grade monopersulfate salts can be used, such as OXONE triple salt formulated with commercial stabilizers and the like, in which case conversion from analyzed % AvO to percentage by weight of commercial-grade OXONE in the composition will include an assay factor. It has been found that commercial OXONE typically contains only about 88 percent by weight of the pure triple salt, accordingly a percentage by weight of the commercial sample will be increased by the assay factor: taking the above-given illustration, if the analyzed Available Oxygen in the composition was 0.78%, the content of 88% commercial OXONE would be:

(0.78/0.0521)*1/0.88=17.01% where 0.88 is the assay factor.

For simplicity, OXONE percentages other than in the detailed Examples are given on a pure basis herein, unless otherwise specifically indicated. Typically, the compositions herein will comprise from about 1% to about 9.5% by weight of MPS (as $HSO_5^-$), which translates into about 3% to about 25% by weight OXONE, dry basis as the pure triple salt.

Preparation of Monopersulfate Salts

While OXONE is commercially available, the invention is not limited to the use of OXONE as the monopersulfate salt. Preparation of alternate monopersulfate salts is given for the convenience of the practitioner.

Preparation of tetrabutylammonium monopersulfate, $Bu_4NHSO_5$, in accordance with literature procedure (after Trost et al, J. Org. Chem., Vol. 53, No.3, 1988, pages 532–537, incorporated herein by reference).

To a solution of OXONE® ($2KHSO_5.KHSO_4.K_2SO_4$, 10.86 g, 18 mmol) in 45 ml water is added tetrabutylammonium bisulfate (30.0 g, 88 mmol) obtainable from Kodak Laboratory and Research Products. After being stirred at room temperature for 0.5 hour, the reaction mixture is extracted with dichloromethane (3×70 ml), the combined organic phase is dried over magnesium sulfate, and the solvent is evaporated in vacuo, yielding a white solid (25.64 g). The solid is titrated three times following this representative procedure: to a 0.1859 g sample is added 0.5 ml glacial acetic acid and 1 ml of 10% aqueous NaI. After dilution to 5 ml of THF, it is titrated with 3.30 ml of a 0.1012M solution of sodium sulfite to the yellow endpoint. The average of the three trials gives 37.5% by weight of active oxidizing agent, $Bu_4NHSO_5$. $^1H$ NMR (200 MHz, $CDCl_3$): δ3.2 (br t, 2H), 1.5 (br s, 2H), 1.3 (q, 2H), 0.85 (t, 3H). $^{13}C$ NMR (15 MHz, $CDCl_3$): δ57.7, 23.4, 29.2, 13.3. The sample is handled with care in accordance with the normal precautions required for a peroxide. Tetrabutylammonium monopersulfate, in impure form as prepared supra, can if desired be multiply recrystallized from methylene chloride. Either the purified form or impure form can be used in the automatic dishwashing detergent compositions of the invention. Tetrabutylammonium monopersulfate can alternately be prepared from tetrabutylammonium bisulfate and a 15% aqueous solution of Caro's acid, is extracted into methylene chloride, and is recrystallized therefrom.

Available Oxygen—Perborate or Percarbonate:

When the present compositions contain sodium perborate or sodium percarbonate, the content of these ingredients may be specified either on an available oxygen basis or on a percentage by weight basis. Using principles similar to those used above, it can readily be computed that sodium perborate monohydrate has a maximum available oxygen content of about 16%. In practice, commercial samples of sodium perborate and sodium percarbonate have typical Available Oxygen contents in the range from about 13% to about 15.5%.

Hydrogen Peroxide Releasing Salt

Hydrogen peroxide sources are useful herein at levels given in the summary. Such compounds are illustrated in detail in the hereinabove incorporated Kirk Othmer review on Bleaching and include the various forms of sodium perborate and sodium percarbonate, including various coated, encapsulated and modified forms. An "effective amount" of a source of hydrogen peroxide is any amount capable of measurably improving stain removal (especially of tea stains) from the soiled substrate, especially dishware, compared to a hydrogen peroxide source-free composition when the soiled substrate is washed by the consumer in a in the presence of alkali.

More generally a source of hydrogen peroxide herein is any convenient compound or mixture which under consumer use conditions in an automatic dishwashing detergent having a 1% by weight aqueous solution pH at or above about 7 provides an effective amount of hydrogen peroxide.

The preferred source of hydrogen peroxide used herein can be any convenient source, including hydrogen peroxide itself. For example, perborate, e.g., sodium perborate (any hydrate but preferably the mono- or tetra-hydrate), sodium carbonate peroxyhydrate or equivalent percarbonate salts, sodium pyrophosphate peroxyhydrate, urea peroxyhydrate, or sodium peroxide can be used herein. Sodium perborate monohydrate and sodium percarbonate are particularly preferred. Mixtures of any convenient hydrogen peroxide sources can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with a silicate, borate or water-soluble surfactants. Percarbonate is available from various commercial sources such as FMC, Solvay and Tokai Denka.

Cationic Bleach Activator

In general, the cationic bleach activator may be any of the art-known types, for example, as illustrated and cited extensively in the background section, all such references being incorporated herein in their entirety; suitable levels are given in the summary.

The cationic or quaternary bleach activator may in general have a single positive charge, two positive charges, three positive charges or may be polycationic. Amphoteric structures can result when there is also incorporated an anionic substituent.

Terminology used in connection with bleach activators, especially the cationic types, is further detailed as follows: it is known in the art that bleach activators will "perhydrolyze" in the presence of hydrogen peroxide to form a "peracid". For example, a bleach activator of the art having the form RC(O)L, wherein RC(O) is an acyl moiety and L is a leaving-group, will react with hydrogen peroxide or a hydrogen peroxide source, such as sodium percarbonate or perborate, to form a "peracid", i.e., a percarboxylic acid RC(O)OOH or its anion, with the loss of a leaving group, L, or its conjugate acid LH. The reaction is termed "perhydrolysis". More generally the terms "peracid" and "peroxyacid" are sometimes used interchangeably in the art and are equivalent terms herein. Types of peracids are nonlimitedly illustrated by peroxyimidic acids, peroxycarbonic acids and peroxycarboxylic acids; more preferably, peroxycarbonic acids and peroxycarboxylic acids.

In general, the term "leaving group" is defined in standard texts, such as "Advanced Organic Chemistry", J. March, 4th Ed., Wiley, 1992, p 205.

The terms "portion" and "moiety" are used with particular meanings herein with respect to the cationic bleach activator component. Specifically, a "moiety" relates to a number of directly covalently connected atoms forming part of a molecule whereas a "portion" is used to identify a number of molecular fragments which have something in common but are not necessarily directly covalently connected. Thus, the polymeric compound:

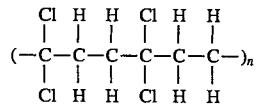

consists of a halogen portion and a non-halogen portion. The non-halogen portion consists of two $CH_2CH_2$ moieties.

A "peracid-forming portion" of a bleach activator is that individual moiety or sum of moieties of the bleach activator molecule which will form peracid entities when the bleach activator undergoes perhydrolysis. Thus, a "peracid-forming portion" will contain at least one moiety which will perhydroyze.

A "leaving group-portion" of a bleach activator is that individual moiety or sum of moieties of the bleach activator molecule which will form a leaving group or leaving groups when the molecule undergoes perhydrolysis. Thus, a leaving group-portion will separate from the peracid-forming portion of the bleach activator upon perhydrolysis of the bleach activator.

A bleach activator molecule, then, typically comprises a peracid-forming portion, a leaving-group portion and, when it has an overall charge, compatible anions or cations will be present.

Consider the case of a conventional, noncharged (noncationic) bleach activator having the formula:

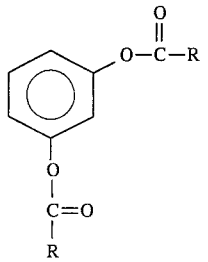

wherein both RC(O) moieties react with hydrogen peroxide, forming two moles of peracid RC(O)OOH per mole of the bleach activator. According to the present definition, this bleach activator comprises a peracid-forming portion which consists of two peracid-forming moieties, RC(O)—; and one leaving-group portion, $C_6H_4O_2$.

A "quaternary nitrogen group" herein is any simple nitrogen-containing moiety of the form:

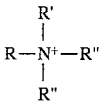

wherein R–R''' represent any acyclic, cyclic or fused substituents, preferably all being nonhydrogen substituents. "Cationic bleach activators" herein most generally are any bleach activators which contain at least one such positively charged nitrogen moiety. The cationic bleach activator can in general be monocationic, dicationic, tricationic or polycationic; preferred embodiments of the present detergent compositions however rely on monocationic, dicationic or tricationic bleach activators; more preferably still, monocationic or tricationic bleach activators are selected.

Compatible anions—Compositions of this invention, especially the cationic bleach activator components, typically comprise charge-balancing compatible anions, "counter-ions" or "counter-anions", identified as "Z" in the cationic bleach activators herein. An index, "z", refers to the number of such counter-ions in the bleach activator. In general, the counter-anions may be monovalent, divalent, trivalent or polyvalent. Available anions such as bromide, chloride or phosphates may be used, though they may be other than preferred for one or another reason, such as bleach reactivity or phosphorus content.

Examples of compatible anions include those selected from the group consisting of sulfate, isethionate, alkanesulfonate, alkyl sulfate, aryl sulfonate, alkaryl sulfonate, carboxylates, polycarboxylates, and mixtures thereof. Additionally, preferred anions include the sulfonates selected from the group consisting of methanesulfonate, ethanesulfonate, benzenesulfonate, p-toluenesulfonate, cumenesulfonate, xylenesulfonate, naphthalene sulfonate and mixtures thereof. Especially preferred of these sulfonates are those which contain aryl. Examples of alkyl sulfates include methyl sulfate and octyl sulfate.

A single bleach activator compound may comprise mixtures of any of the compatible anions in charge balancing amounts, e.g., a mixture of sulfonates to chlorides may comprise a ratio of from about 1:10 to about 10:1, preferably from about 1:10 to about 5:1. As another example, a bleach activator having an overall charge of +3 in the cation may comprise a mixture of one equivalent of $CH_3SO_4^-$ and two equivalents of $Cl^-$ as the compatible anions. Polycarboxylate anions suitable herein are nonlimitingly illustrated by terephthalate, polyacrylate, polymaleate, poly (acrylate-co-maleate), or similar polycarboxylates; preferably such polycarboxylates have low molecular weights, e.g., 1,000–4,500. Suitable monocarboxylates are further illustrated by benzoate, naphthoate, p-toluate, and similar hard-water precipitation-resistant monocarboxylates.

In other preferred embodiments, the cationic bleach activator herein has charge-balancing compatible anions selected from the group consisting of: alkanesulfonate, alkarylsulfonate and aryl sulfonate, provided that the critical micelle concentration of the sodium salt form of any of said sulfonates is $10^{-1}$ molar or above. Alternately, said charge-balancing compatible anions of said monocationic bleach activator are selected from the group consisting of methylsulfate, methanesulfonate, ethanesulfonate, benzenesulfonate, p-toluenesulfonate, cumenesulfonate, xylenesulfonate, naphthalenesulfonate and mixtures thereof.

Preparation of Cationic Bleach Activators

While cationic bleach activators suitable for use herein are generally known from the art, suitable compounds and preparations thereof are given for the convenience of the practitioner.

Preparation of
6-(N,N,N-Trimethylammonio)hexanoyl
Caprolactam p-Toluenesulfonate (compound 5;
referred to as "Cationic Bleach Activator A"
hereinafter in the Examples

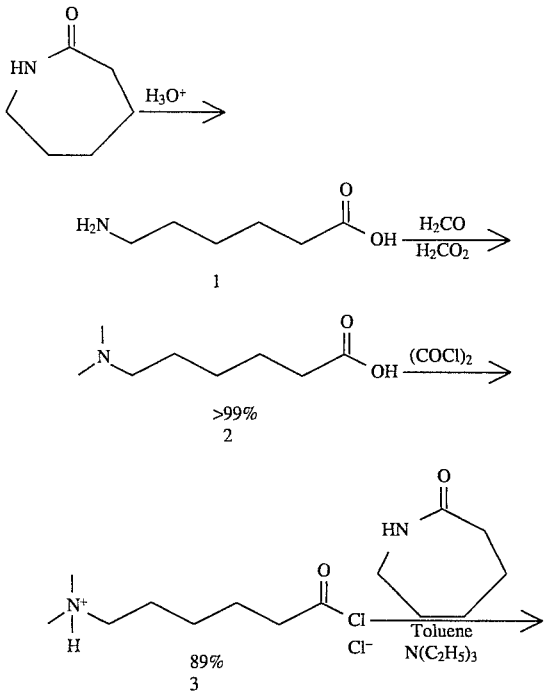

-continued

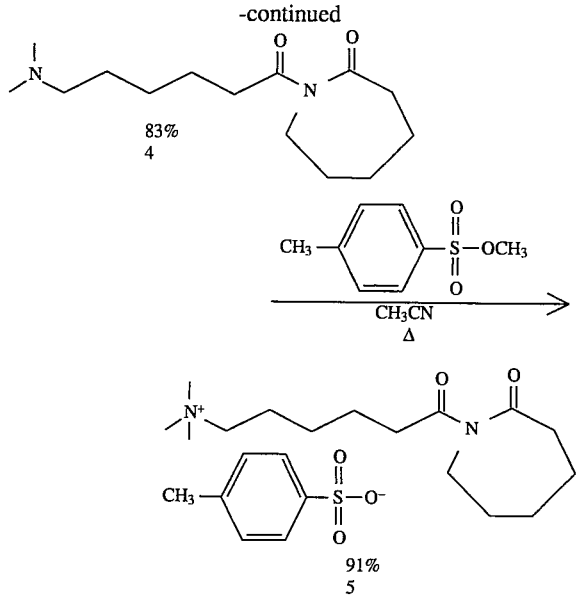

6-(N,N-Dimethyiamino)hexanoic acid (2)

To a 2000 mL three-necked round-bottomed flask equipped with an internal thermometer and reflux condenser are added 6-aminocaproic acid (200.00 g, 1.53 mol), formaldehyde (357.61 g, 4.41 mol, 37 wt %), and formic acid (454.56 g, 8.69 mol, 88%). Once addition is complete, the mixture is heated to reflux for 3 h, then cooled to room temperature. Analysis by TLC (74:25:1, propanol:water:formic acid, $R_f$32 0.45) indicates the reaction is complete. To the crude mixture is added 158 mL of concentrated HCl (36–37%). The mixture is concentrated to dryness by rotary evaporation for 5 h to remove excess formaldehyde and formic acid. The hydrochloride is redissolved in 300 mL of water and neutralized with 132.5 g of 50 wt % NaOH solution to a pH of about 7.0. The mixture is concentrated by rotary evaporation with isopropanol to facilitate drying. The product is leached out from the solids by triturating with dichloromethane. After drying the organic layer over $MgSO_4$ and filtering, the product is isolated by concentrating the organic layer by rotary evaporation and drying under vacuum to give 2 as a white solid, 251.86 g (>99% yield): mp 89°–91° C.

6-(N,N-Dimethylamino)hexanoyl chloride hydrochloride (3)

Into a 5000 mL three-necked round-bottomed flask equipped with a reflux condenser, internal thermometer, mechanical stirrer, and argon inlet, is placed oxalyl chloride (398.67 g, 3.14 mol). Acid 2 (100 g, 0.63 mol) is added over 30 min while maintaining the reaction temperature at 40° C. As reaction takes place, $CO_2$ and CO are swept away from the mixture with argon. After addition is complete, the mixture is stirred for 2 h while the reaction flask cools to room temperature. Excess oxalyl chloride is removed by rotary evaporation at 50° C. and then by Kugelrohr distillation at 50° C. (0.1 mm Hg) for 2 h. Isolated is 3, 118.98 g (88.5%) as an oil that solidifies on standing.

6-(N,N-Dimethylamino)hexanoyl caprolactam (4)

To a 1000 mL three-necked round-bottomed flask equipped with a reflux condenser, internal thermometer, argon inlet, and mechanical stirrer, are added ϵ-caprolactam (48.04 g, 0.42 mol), toluene (340 mL), and triethylamine (189.00 g, 1.87 mol). The mixture is heated to reflux (ca. 101° C.) for 15 min. While at that temperature, acid chloride 3 (100.00 g, 0.47 mol) is added as a solid over 30 min. The reaction is maintained at reflux for an additional 1.75 h before the heat is removed. At room temperature, the mixture is filtered and the salts washed with toluene. The dark filtrate is washed with saturated sodium bicarbonate solution (3×250 mL), water (100 mL), and dried over $MgSO_4$. The mixture is filtered and concentrated by rotary evaporation at about 50° C. (water aspirator) and then by Kugelrohr distillation at 60° C. for 1 h to give 89.64 g (83%) of 4 as a dark red oil.

6-(N,N,N-Trimethylammonio)hexanoyl caprolactam p-toluenesulfonate (5)

In a 500 mL three-necked round-bottomed flask fitted with an argon inlet, condenser, and stir bar are placed amine amide 4 (17.94 g, 0.071 mol), acetonitrile (200 mL), and methyl p-toluenesulfonate (13.13 g, 0.071 mol). While adding the tosylate, the reaction mixture mildly exotherms. The mixture is heated to reflux for 3 h and is then cooled to room temperature. While concentrating the mixture by rotary evaporation, a tan solid forms which is redissolved in a minimal amount of acetonitrile and triturated with ether until a free flowing dispersion of the solid is obtained in the solvent system. The solid is collected by vacuum filtration under a blanket of nitrogen and transferred to a round-bottomed flask. The solid product is a suitable cationic bleach activator. It is dried at room temperature under vacuum (0.1 mmHg) for 24 h to give 5 (Cationic Bleach Activator A) (27.84 g, 90%) as an off-white solid, mp 128°–131° C. (softens at 118° C.).

N,N-Bis[2-((phenoxycarbonyl)oxy)ethyl]-N,N-dimethylammonium Methylsulfate (10) (Referred to hereinafter in the Examples as "Cationic Bleach Activator B"

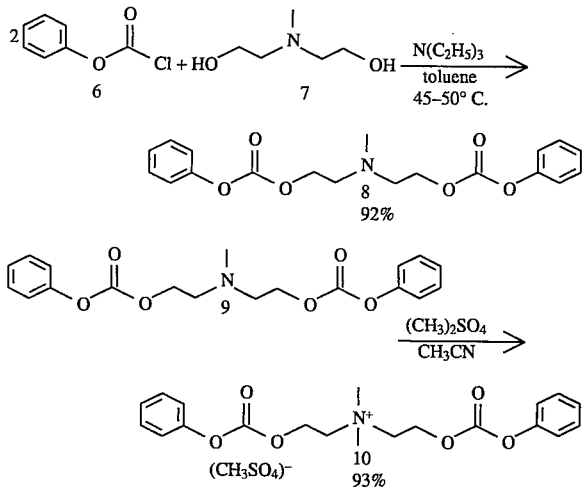

Preparation of N,N-Bis[2-((phenoxycarbonyl)oxy)ethyl]-N-methylamine (9).

To a 500 ml three-necked round-bottomed flask equipped with an internal thermometer, reflux condenser, mechanical stirrer, addition funnel, and argon inlet are added N-methyldiethanolamine (20.00 g, 0.168 mol), toluene (200 ml), and triethylamine (37.36 g, 0.369 mol). The mixture is treated with a solution of phenylchloroformate (52.56 g, 0.336 mol) dissolved in 50 ml of toluene so as to maintain the reaction temperature at 35°–45° C. After addition is complete, the mixture is heated at 45° C. for an additional 1.5 h. The cooled mixture is washed with saturated sodium bicarbonate solution (2×200 ml) and water (200 ml). The organic phase is dried over $MgSO_4$, filtered, and concentrated first by rotary evaporation at 50° C. (water aspirator vacuum) and then at 80° C. (0.02 mmHg) in a Kugelrohr oven to give 9 as a light yellow oil, 55.65 g (92%) that crystallizes on standing.

Preparation of N,N-Bis[2-((phenoxycarbonyl)oxy)ethyl]-N,N-dimethylammonium Methylsulfate (10).

To a 1000 ml three-necked round-bottomed flask fitted with a reflux condenser, magnetic stiffer, internal thermometer, addition funnel, and argon inlet are added N,N-bis[2-((phenoxycarbonyl)oxy)ethyl]-N-methylamine (100.00 g, 0.278 mol), acetonitrile (270 ml), and dimethylsulfate (35.93 g, 0.278 mol) over 10 min. After addition is complete, the mixture is heated to reflux for 2 h. The cooled mixture is treated with ether (500 ml). The product precipitates from the mixture after approximately 15 min to give 10 as a white powder, 126.26 g (93%): mp 85°–87° C.

Preparation of N,N-Bis[2-((phenoxycarbonyl)oxy)ethyl]-N,N-dimethylammonium p-Toluenesulfonate (15) (Referred to hereinafter in the Examples as "Cationic Bleach Activator B2")

To a 250 ml round-bottomed flask fitted with a reflux condenser, magnetic stirrer, and argon inlet are added N,N-bis[2-((phenoxycarbonyl)oxy)ethyl]-N-methylamine (25.00 g, 69.6 mmol), acetonitrile (100 ml), and methyl p-toluenesulfonate (12.95 g, 69.6 mmol). After addition is complete, the mixture is heated to reflux for 2 h. The cooled mixture is treated with ether (500 ml). The product precipitates from the mixture and dried to give 5 as a white powder, 31.14 g (81%): mp 117°–118° C.

N,N,N,N',N',N'-Hexamethyl-2-[6'-(N",N",N"-trimethylammonio)hexanoyloxy]-1,3-propanediammonium tri(methylsulfate) (15) (Referred to hereinafter in the Examples as "Cationic Bleach Activator C")

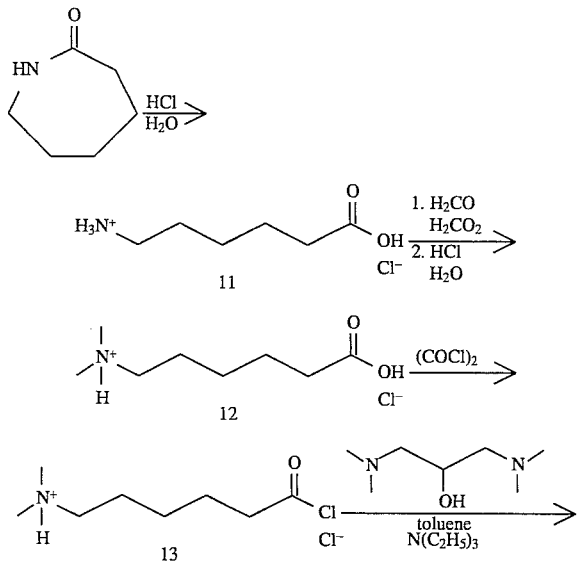

-continued

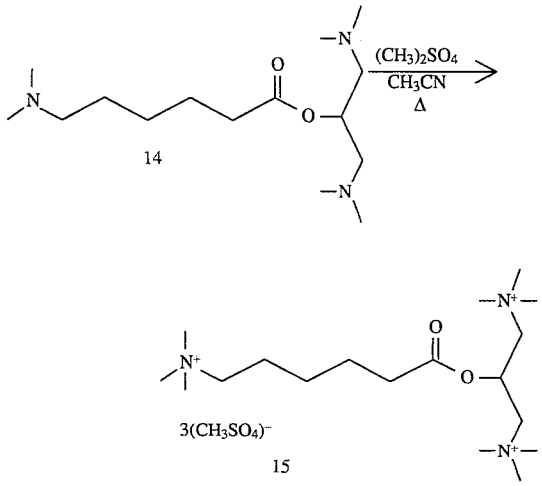

6-Aminohexanoic acid hydrochloride (11)

ε-Caprolactam (750.00 g, 6.63 mol), water (1500 mL), and concentrated HCl (675 mL, 36–38%) are combined in a 5000 mL three-necked round bottomed flask fitted with a mechanical stirrer and condenser. The mixture is heated for 4 h at reflux, cooled to room temperature, and concentrated by rotary evaporation at 50° C. (water aspirator vacuum) to give 11 as a white solid. The absence of e-caprolactam by TLC ($R_f$=0.21, THF) indicates the reaction is complete.

6-(N,N-Dimethylamino)hexanoic acidhydrochloride (12)

6-Aminohexanoic acidhydrochloride (1204 g, 6.63 mol, 92%—balance being water), formaldehyde (577.37 g, 19.23 mol, 37wt %), and formic acid (1739.50 g, 37.79 mol, 88%) are divided into two 5000 mL three-necked round-bottomed flasks each fitted with a condenser and magnetic stirrer. Each mixture is heated at reflux for 21 h, cooled to room temperature, and treated with concentrated HCl (226 mL, 36–38% in each flask). The combined reaction mixtures are concentrated to near dryness by rotary evaporation for 3 h at 70° C. and then further concentrated in a Kugelrohr oven at 60° C. for 2 h to give 12, 1202.68 g (93% based on ε-caprolactam starting material) of a white crystalline solid.

6-(N,N-Dimethylamino)hexanoyl chloridehydrochloride (13)

Oxalyl chloride (3367.33 g, 26.53 mol) is placed in a 5000 mL three-necked round-bottomed flask equipped with a reflux condenser, internal thermometer, mechanical stirrer, and argon inlet. 6-(N,N-Dimethylamino)hexanoic acidthydrochloride (1146.00 g, 5.86 mol) is added over 3 h while maintaining the reaction temperature between 25°–35° C. As reaction takes place, HCl, $CO_2$, and CO are swept away from the mixture with argon. After addition is complete, the mixture is cooled to room temperature over 45 min. Excess oxalyl chloride is removed first by rotary evaporation at 50° C. (water aspirator vacuum) and then by Kugelrohr distillation at 60° C. (0.3 mm Hg) for 3 h. A quantitative yield of 13 is isolated as a dark red oil that solidifies on standing.

2-[6'-(N,N-Dimethylamino)hexaneoyloxy]-N',N',N",N"-tetramethyl-1,3-propanediamine (14)

Into a 250 mL three-necked round-bottomed flask equipped with a condenser, mechanical stirrer, argon inlet, and addition funnel are placed 1,3-bis(dimethylamino)-2-propanol (10.00 g, 68.4 mmol), toluene (100 mL), and triethylamine (16.75 g, 165.5 mmol). The mixture is brought to reflux and treated with a solution of 6-(N,N-dimethylamino)hexanoyl chloridehydrochloride (16.11 g, 75.2 mmol) dissolved in dichloromethane (20 mL) over 30 min. After refluxing 3 h, the cooled mixture is filtered and the filter cake washed with toluene until the washings are colorless. The combined filtrate and washings are extracted with saturated sodium bicarbonate solution (2×100 mL), water (100 mL), dried over $MgSO_4$, and filtered. The solution is concentrated by rotary evaporation to give a brown oil. The resulting oil is distilled by Kugelrohr distillation (80°–90° C., 0.05 mmHg) to give 8.14 g (41.4%) of 14.

N,N,N,N',N',N'-Hexamethyl-2-[6'-(N",N",N"-trimethylammonio)hexanoyloxy]-1,3-propanediamonium tri(methylsulfate) (15) 2-[6'-(N,N-Dimethylamino)hexanoyloxy]-N',N',N",N"-tetramethyl-1,3-propanediamine (8.13 g, 28.3 mmol) and acetonitrile (50 mL) are placed in a 100 mL round bottomed flask. Dimethyl sulfate (10.70 g, 84.8 mmol) is added and the mixture heated to reflux for 3 h under argon. The cooled mixture is poured into ether (500 mL) and stirred. The product crystallizes in the solution. The product is collected by vacuum filtration affording 18.08 g (96.0%) of 15 (Cationic Bleach Activator C) as a white solid.

Preferred Embodiments

While certain preferred embodiments are described in the summary, the invention is further illustrated by the following: preferred embodiments of the instant compositions include a detergent composition having granular form; said detergent composition further comprising one or more automatic dishwashing detergent adjunct materials; said automatic dishwashing adjunct material being selected such that the composition produces less than 2 inches of suds when dissolved in water in a domestic automatic dishwasher at a concentration of from about 0.2% to about 0.4% by weight of the automatic dishwashing detergent composition.

Desirably the detergent composition comprises, as part or all of the automatic dishwashing adjunct material, one or more low-foaming nonionic surfactants (LFNI). Preferably, said low-foaming nonionic surfactant is a waxy material and is incorporated into said composition at least partially as a coating upon said cationic bleach activator. Suitable LFNI are further illustrated hereinafter. Also encompassed is a detergent composition wherein said cationic bleach activator is an acyl compound; wherein said cationic bleach activator provides a quaternary-substituted peroxycarboxylic acid or a quaternary substituted peroxycarbonic acid on perhydrolysis, terms being as defined hereinabove. Preferably said cationic bleach activator comprises (i) a peracid-forming portion selected from a peroxycarboxylic acid-forming portion and a peroxycarbonic acid-forming portion and (ii) a leaving-group portion; and wherein:—said peroxycarboxylic acid or peroxycarbonic acid-forming portion comprises at least one quaternary nitrogen group and forms an aliphatic peroxycarboxylic acid or an aliphatic peroxycarbonic acid on perhydrolysis; and—said leaving-group portion comprises from 0 to 2 quaternary nitrogen groups. Preferably also, said portion (i) of said cationic bleach activator comprises exactly one quaternary nitrogen group. In highly preferred embodiments, said cationic bleach activator comprises exactly one peroxycarboxylic acid-forming moiety or peroxycarbonic acid-forming moiety in said portion (i) and exactly one leaving-group moiety in said leaving-group portion (ii); and wherein said moieties are covalently connected. In other preferred embodiments, the cationic bleach activator comprises a leaving-group, L, selected from the group consisting of caprolactam and valerolactam, though other common leaving groups as taught, for examples, in U.S. Pat. No. 5,106,528 such as oxybenzenesulfonate, are also suitable for use herein.

To further illustrate the invention, there are encompassed herein detergent compositions wherein said cationic bleach activator is selected from the group consisting of monocationic bleach activator compounds having the formula: $(E—W—C(O)—L)(Z^{a-})_{1/a}$ wherein E contains a tetravalent nitrogen atom, W is substituted or unsubstituted polyalkylene, arylalkylene, arylpolyalkylene, polyalkylenearylalkylene or poly-alkylenearylpolyalkylene provided that from about 2 to about 16 atoms separate the nitrogen in said moiety E and said moiety C(O); L is said leaving-group; a is 1 or higher; and $(Z^{a-})_{1/a}$ are charge-balancing compatible anions of said monocationic bleach activator compound. Preferably, in such embodiments, E has the formula $R^1R^2R^3N^+$ wherein any R is independently selected from methyl, ethyl, propyl, butyl, phenyl, benzyl, 1-naphthylmethylene and 2-naphthylmethylene; and W has formula selected from: $—(CH_2)_n—$ wherein n is from about 3 to about 12; and $—(C_6H_4)_{n'}—$ wherein n' is from 1 to about 8. More preferably, E is selected from the group consisting of: $(CH_3)_3N^+$, $(CH_3)_2(C_6H_5CH_2)N^+$, $(CH_3)_2(Np)N^+$ and mixtures thereof, wherein Np is said naphthylmethylene; W is $—(CH_2)_n—$ wherein n is from about 3 to about 6; and said charge-balancing compatible anions of said monocationic bleach activator are selected from the group consisting of: sulfate, alkanesulfate, chloride, alkane sulfonate, aryl sulfonate, alkaryl sulfonate, polycarboxylates, and mixtures thereof.

In highly preferred embodiments, said cationic bleach activator is a salt comprising a cation having the structure:

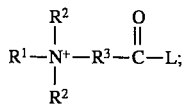

wherein

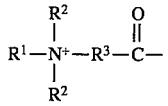

is said peroxycarboxylic acid-forming moiety (i) and L is said leaving-group moiety (ii); L comprises two quaternary nitrogen groups; $R^1$ is $C_1$–$C_{12}$ hydrocarbyl; any $R_2$ is independently selected from $C_1$–$C_4$ alkyl, $C_1$–$C_4$ hydroxyalkyl and benzyl; and $R_3$ is selected from the group consisting of $C_1$–$C_{10}$ hydrocarbyl, $R^5NH$, $R^5NH$, $R^5NR^6$ and $R^5O$ wherein $R^5$ when present, is $C_1$–$C_{10}$ hydrocarbyl; and $R^6$, when present, is $C_1$–$C_4$ hydrocarbyl.

Also encompassed is a detergent composition wherein said bleach activator is substantially free from linear hydrocarbon chains having more than 6 carbon atoms and L is

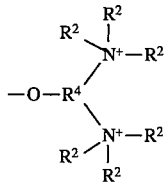

wherein $R^4$ is alkylene and $R^2$ is $C_1$–$C_4$ alkyl and $R^4$ is

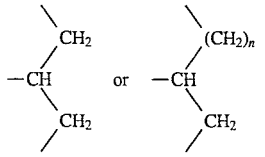

wherein n is from 1 to 4.

In another alternative embodiment, said cationic bleach activator is selected from:

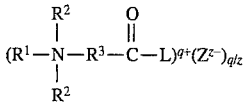

wherein L comprises from 0 to 2 quaternary nitrogen groups; $R^1$ is $C_1$–$C_{12}$ hydrocarbyl; any $R^2$ is independently selected from $C_1$–$C_4$ alkyl, $C_1$–$C_4$ hydroxyalkyl, and benzyl; and $R^3$ is $C_1$–$C_{10}$ hydrocarbyl; q is from 3 to 6; and Z is a compatible anion having charge z- selected from the group consisting of bromide, chloride, phosphates, isethionate, carboxylates, polycarboxylates, methanesulfonate, ethanesulfonate, benzenesulfonate, p-toluenesulfonate, cumenesulfonate, xylenesulfonate, naphthalene sulfonate, methyl sulfate, octyl sulfate, and mixtures thereof.

The compositions herein can, if desired, further comprise: from about 0.001% to about 1% by weight of a transition metal bleach catalyst selected from Cobalt catalysts and Iron catalysts.

Preferably, when present, said bleach catalyst is a cobalt (III) complex having the formula: $[Co(NH_3)_n(M)_m(B)_b]\ T_y$ wherein n is from 4 to 6; M is one or more monodentate ligands other than ammonia; m is from 0 to 2; when b=0, m+n=6; B, when present, is a bidentate ligand; b is from 0 to 1; when b is 1, n+b=5; and T is one or more appropriately selected counteranions present in a number y, where y is an integer from 0 to 3 to obtain a charge-balanced salt; and wherein further said catalyst has a base hydrolysis rate constant of less than $2300\times10^4\ Mol^{-1}\ sec^{-1}$ at 25° C.

It may further be desired to complement the excellent tea-stain removing ability of the compositions by adding a carotenoid stain removal adjunct selected from:—from about 0.001% to about 1.5% by weight of a diacyl peroxide; and—from about 0.001% to about 1.5% by weight of a noncharged hydrophobic bleach activator. Noncharged hydrophobic bleach activators are nonlimitingly illustrated by nonanoyloxybenzenesulfonate and structurally similar activators comprising an amide moiety.

Preferred compositions herein have a 0.4% aqueous solution pH of from about 9 to about 11.5 and a free moisture content, as prepared, not greater than about 7%.

Adjunct Materials:

Detersive ingredients or adjuncts optionally included in the instant compositions can include one or more materials for assisting or enhancing cleaning performance, treatment of the substrate to be cleaned, or designed to improve the aesthetics of the compositions. They are further selected based on the form of the composition, i.e., whether the composition is to be sold as a liquid, paste (semisolid), or solid form (including tablets and the preferred granular forms for the present compositions). Adjuncts which can also be included in compositions of the present invention, at their conventional art-established levels for use (generally, adjunct materials comprise, in total, from about 30% to about 99.9%, preferably from about 70% to about 95%, by weight of the compositions), include other active ingredients such as dispersant polymers (e.g., from BASF Corp. or Rohm & Haas), color speckles, silvercare, anti-tarnish and/or anti-corrosion agents, dyes, fillers, germicides, alkalinity sources, hydrotropes, anti-oxidants, enzyme stabilizing agents, perfumes, solubilizing agents, carriers, processing aids, pigments, and, for liquid formulations, solvents, as described in detail hereinafter.

1. Detergent Surfactants:

(a) Low-Foaming Nonionic Surfactant—Surfactants are useful in Automatic Dishwashing to assist cleaning, help defoam food soil foams, especially from proteins, and to help control spotting/filming and are desirably included in the present detergent compositions at levels of from about 0.1% to about 20% of the composition. In general, bleach-stable surfactants are preferred. ADD (Automatic Dishwashing Detergent) compositions of the present invention preferably comprise low foaming nonionic surfactants (LFNIs). LFNI can be present in amounts from 0 to about 10% by weight, preferably from about 0.25% to about 4%. LFNIs are most typically used in ADDs on account of the improved water-sheeting action (especially from glass) which they confer to the ADD product. They also encompass nonsilicone, nonphosphate polymeric materials further illustrated hereinafter which are known to defoam food soils encountered in automatic dishwashing.

Preferred LFNIs include nonionic alkoxylated surfactants, especially ethoxylates derived from primary alcohols, and blends thereof with more sophisticated surfactants, such as the polyoxypropylene/polyoxyethylene/polyoxypropylene (PO/EO/PO) reverse block polymers. The PO/EO/PO polymer-type surfactants are well-known to have foam suppressing or defoaming action, especially in relation to common food soil ingredients such as egg.

The invention encompasses preferred embodiments wherein LFNI is present, and wherein this component is solid at about 95° F. (35° C.), more preferably solid at about 77° F. (25° C.). For ease of manufacture, a preferred LFNI has a melting point between about 77° F. (25° C.) and about 140° F. (60° C.), more preferably between about 80° F. (26.6° C.) and 110° F. (43.3° C.).

In a preferred embodiment, the LFNI is an ethoxylated surfactant derived from the reaction of a monohydroxy alcohol or alkylphenol containing from about 8 to about 20 carbon atoms, with from about 6 to about 15 moles of ethylene oxide per mole of alcohol or alkyl phenol on an average basis.

A particularly preferred LFNI is derived from a straight chain fatty alcohol containing from about 16 to about 20 carbon atoms ($C_{16}$–$C_{20}$ alcohol), preferably a $C_{18}$ alcohol, condensed with an average of from about 6 to about 15 moles, preferably from about 7 to about 12 moles, and most preferably from about 7 to about 9 moles of ethylene oxide per mole of alcohol. Preferably the ethoxylated nonionic surfactant so derived has a narrow ethoxylate distribution relative to the average.

The LFNI can optionally contain propylene oxide in an amount up to about 15% by weight. Other preferred LFNI surfactants can be prepared by the processes described in U.S. Pat. No. 4,223,163, issued Sep. 16, 1980, Builloty, incorporated herein by reference.

Highly preferred ADDs herein wherein the LFNI is present make use of ethoxylated monohydroxy alcohol or alkyl phenol and additionally comprise a polyoxyethylene, polyoxypropylene block polymeric compound; the ethoxylated monohydroxy alcohol or alkyl phenol fraction of the LFNI comprising from about 20% to about 100%, preferably from about 30% to about 70%, of the total LFNI.

Suitable block polyoxyethylene-polyoxypropylene polymeric compounds that meet the requirements described hereinbefore include those based on ethylene glycol, propylene glycol, glycerol, trimethylolpropane and ethylenediamine as initiator reactive hydrogen compound. Polymeric compounds made from a sequential ethoxylation and propoxylation of initiator compounds with a single reactive hydrogen atom, such as $C_{12-18}$ aliphatic alcohols, do not generally provide satisfactory suds control in the instant ADDs. Certain of the block polymer surfactant compounds designated PLURONIC® and TETRONIC® by the BASF-Wyandotte Corp., Wyandotte, Mich., are suitable in ADD compositions of the invention.

A particularly preferred LFNI contains from about 40% to about 70% of a polyoxypropylene/polyoxyethylene/polyoxypropylene block polymer blend comprising about 75%, by weight of the blend, of a reverse block co-polymer of polyoxyethylene and polyoxypropylene containing 17 moles of ethylene oxide and 44 moles of propylene oxide; and about 25%, by weight of the blend, of a block copolymer of polyoxyethylene and polyoxypropylene initiated with trimethylolpropane and containing 99 moles of propylene oxide and 24 moles of ethylene oxide per mole of trimethylolpropane.

Suitable for use as LFNI in the ADD compositions are those LFNI having relatively low cloud points and high hydrophilic-lipophilic balance (HLB). Cloud points of 1% solutions in water are typically below about 32° C. and preferably lower, e.g., 0° C., for optimum control of sudsing throughout a full range of water temperatures.

LFNIs which may also be used include a $C_{18}$ alcohol polyethoxylate, having a degree of ethoxylation of about 8, commercially available as SLF18 from Olin Corp., and any biodegradable LFNI having the melting point properties discussed hereinabove.

(b) Anionic Co-surfactant—The automatic dishwashing detergent compositions herein are preferably substantially free from anionic co-surfactants. It has been discovered that certain anionic co-surfactants, particularly fatty carboxylic acids, can cause unsightly films on dishware. Moreover, many anionic surfactants are high foaming. If present, the anionic co-surfactant is typically of a type having good solubility in the presence of calcium. Such anionic co-surfactants are further illustrated by sulfobetaines, alkyl(polyethoxy)sulfates (AES), alkyl(polyethoxy)carboxylates, and short chained $C_6$–$C_{10}$ alkyl sulfates.

2. Detersive Enzymes

"Detersive enzyme", as used herein, means any enzyme having a cleaning, stain removing or otherwise beneficial effect in an ADD composition. Preferred detersive enzymes are hydrolases such as proteases, amylases and lipases. Highly preferred for automatic dishwashing are amylases and/or proteases, including both current commercially available types and improved types which, though more bleach compatible, have a remaining degree of bleach deactivation susceptibility.

In general, as noted, preferred ADD compositions herein comprise one or more detersive enzymes. If only one enzyme is used, it is preferably an amyolytic enzyme when the composition is for automatic dishwashing use. Highly preferred for automatic dishwashing is a mixture of proteolytic enzymes and amyloytic enzymes.

More generally, the enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders, etc. In this respect bacterial or fungal enzymes are preferred, such as bacterial amylases and proteases, and fungal cellulases.

Enzymes are normally incorporated in the instant detergent compositions at levels sufficient to provide a "cleaning-effective amount". The term "cleaning-effective amount" refers to any amount capable of producing a cleaning, stain removal or soil removal effect on substrates such as fabrics, dishware and the like. Since enzymes are catalytic materials, such amounts may be very small. In practical terms for current commercial preparations, typical amounts are up to about 5 mg by weight, more typically about 0.01 mg to about 3 mg, of active enzyme per gram of the composition. Stated otherwise, the compositions herein will typically comprise from about 0.001% to about 6%, preferably 0.01%–1% by weight of a commercial enzyme preparation. Protease enzymes are usually present in such commercial preparations at levels sufficient to provide from 0.005 to 0.1 Anson units (AU) of activity per gram of composition. For automatic dishwashing purposes, it may be desirable to increase the active enzyme content of the commercial preparations, in order to minimize the total amount of non-catalytically active materials delivered and thereby improve spotting/filming results.

Suitable examples of proteases are the subtilisins which are obtained from particular strains of *B. subtilis* and *B. licheniformis*. Another suitable protease is obtained from a strain of Bacillus, having maximum activity throughout the pH range of 8–12, developed and sold by Novo Industries A/S as ESPERASE®. The preparation of this enzyme and analogous enzymes is described in British Patent Specification No. 1,243,784 of Novo. Proteolytic enzymes suitable for removing protein-based stains that are commercially available include those sold under the tradenames ALCALASE® and SAVINASE® by Novo Industries A/S (Denmark) and MAXATASE® by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

An especially preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +1 204, +206, +210, +216, +217, +218, +222, +260, +265, and/or the numbering of *Bacillus amyloliquefaciens* subtilisin, as described in the patent applications of A. Baeck, et al, entitled "Protease-Containing Cleaning Compositions" having U.S. Ser. No. 08/322,676, and C. Ghosh, et al, "Bleaching Compositions Comprising Protease Enzymes" having U.S. Ser. No. 08/322,677, both filed Oct. 13, 1994.

Amylases suitable herein include, for example, α-amylases described in British Patent Specification No. 1,296,839 (Novo), RAPIDASE®, International Bio-Synthetics, Inc. and TERMAMYL®, Novo Industries.

Engineering of enzymes (e.g., stability-enhanced amylase) for improved stability, e.g., oxidative stability is known. See, for example J.Biological Chem., Vol. 260, No. 11, June 1985, pp 6518–6521. "Reference amylase" refers to a conventional amylase inside the scope of the amylase component of this invention. Further, stability-enhanced amylases, also within the invention, are typically compared to these "reference amylases".

The present invention, in certain preferred embodiments, can makes use of amylases having improved stability in detergents, especially improved oxidative stability. A convenient absolute stability reference-point against which amylases used in these preferred embodiments of the instant invention represent a measurable improvement is the stability of TERMAMYL® in commercial use in 1993 and available from Novo Nordisk A/S. This TERMAMYL® amylase is a "reference amylase", and is itself well-suited for use in the ADD (Automatic Dishwashing Detergent) compositions of the invention. Even more preferred amylases herein share the characteristic of being "stability-enhanced" amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, all measured versus the above-identified reference-amylase. Preferred amylases herein can demonstrate further improvement versus more challenging reference amylases, the latter reference amylases being illustrated by any of the precursor amylases of which preferred amylases within the invention are variants. Such precursor amylases may themselves be natural or be the product of genetic engineering. Stability can be measured using any of the art-disclosed technical tests. See references disclosed in WO 94/02597, itself and documents therein referred to being incorporated by reference.

In general, stability-enhanced amylases respecting the preferred embodiments of the invention can be obtained from Novo Nordisk A/S, or from Genencor International.

Preferred amylases herein have the commonality of being derived using site-directed mutagenesis from one or more of the Baccillus amylases, especialy the Bacillus alpha-amylases, regardless of whether one, two or multiple amylase strains are the immediate precursors.

As noted, "oxidative stability-enhanced" amylases are preferred for use herein despite the fact that the invention makes them "optional but preferred" materials rather than essential. Such amylases are non-limitingly illustrated by the following:

(a) An amylase according to the hereinbefore incorporated WO/94/02597, Novo Nordisk A/S, published Feb. 3, 1994, as further illustrated by a mutant in which substitution is made, using alanine or threonine (preferably threonine), of the methionine residue located in position 197 of the *B. licheniformis* alpha-amylase, known as TERMAMYL®, or the homologous position variation of a similar parent amylase, such as *B. amyloliquefaciens, B. subtilis*, or *B. stearothermophilus*;

(b) Stability-enhanced amylases as described by Genencor International in a paper entitled "Oxidatively Resistant alpha-Amylases" presented at the 207th American Chemical Society National Meeting, Mar. 13–17 1994, by C. Mitchinson. Therein it was noted that bleaches in automatic dishwashing detergents inactivate alpha-amylases but that improved oxidative stability amylases have been made by Genencor from *B. licheniformis* NCIB8061. Methionine (Met) was identified as the most likely residue to be modified. Met was substituted, one at a time, in positions 8,15,197,256,304,366 and 438 leading to specific mutants, particularly important being M197L and M197T with the M197T variant being the most stable expressed variant. Stability was measured in CASCADE® and SUNLIGHT®;

(c) Particularly preferred herein are amylase variants having additional modification in the immediate parent available from Novo Nordisk A/S. These amylases do not yet have a tradename but are those referred to by the supplier as QL37+M197T.

Any other oxidative stability-enhanced amylase can be used, for example as derived by site-directed mutagenesis from known chimeric, hybrid or simple mutant parent forms of available amylases.

Cellulases usable in, but not preferred, for the present invention include both bacterial or fungal cellulases. Typically, they will have a pH optimum of between 5 and 9.5. Suitable cellulases are disclosed in U.S. Pat. No. 4,435,307, Barbesgoard et al, issued Mar. 6, 1984, which discloses fungal cellulase produced from *Humicola insolens* and Humicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE-OS-2.247.832. CAREZYME® (Novo) is especially useful.

Suitable lipase enzymes for detergent use include those produced by microorganisms of the Pseudomonas group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P."Other commercial lipases include Amano-CES, lipases ex *Chromobacter viscosum*, e.g. *Chromobacter viscosum* var. lipolyticum NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases ex *Pseudomonas gladioli*. The LIPOLASE® enzyme derived from *Humicola lanuginosa* and commercially available from Novo (see also EPO 341,947) is a preferred lipase for use herein. Another preferred lipase enzyme is the D96L variant of the native Humicola lanuginosa lipase, as described in WO 92/05249 and Research Disclosure No. 35944, Mar. 10, 1994, both published by Novo. In general, lipolytic enzymes are less preferred than amylases and/or proteases for automatic dishwashing embodiments of the present invention.

Peroxidase enzymes can be used in combination with oxygen sources, e.g., percarbonate, perborate, persulfate, hydrogen peroxide, etc. They are typically used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S. The present invention encompasses peroxidase-free automatic dishwashing composition embodiments.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

(a) Enzyme Stabilizing System—The enzyme-containing compositions, especially liquid compositions, herein may comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such stabilizing systems can comprise calcium ion, boric acid, propylene glycol, short chain carboxylic acid, boronic acid, and mixtures thereof.

The stabilizing system of the ADDs herein may further comprise from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme during dishwashing is relatively large; accordingly, enzyme stability in-use is sometimes problematic. Since perborate or percarbonate, which have the ability to react with chlorine bleach, are present in the instant compositions in amounts accounted for separately from the stabilizing system, the use of additional stabilizers is, in general, not essential.

Suitable chlorine scavenger anions are however widely known and readily available, and, if used, can be salts containing ammonium cations with sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartate, salicylate, etc., and mixtures thereof can be used if desired. In general, since the chlorine scavenger function can be performed by several of the ingredients separately listed under better recognized functions, (e.g., other components of the invention such as sodium perborate), there is no requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any scavenger which is majorly incompatible with other ingredients, if used. In relation to the use of ammonium salts, such salts can be simply admixed with the detergent composition but are prone to adsorb water and/or liberate ammonia during storage. Accordingly, such materials, if present, are desirably protected in a particle such as that described in U.S. Pat. No. 4,652,392, Baginski et al.

3. Optional Bleach Adjuncts (a) Noncationic Bleach Activators—Noncationic Bleach activator components are optional materials for the inventive compositions. Such activators are typified by TAED (tetraacetylethylenediamine). Numerous conventional activators are known. See for example U.S. Pat. No. 4,915,854, issued Apr. 10, 1990 to Mao et al, and U.S. Pat. No. 4,412,934. Nonanoyloxybenzene sulfonate (NOBS) or acyl lactam activators may be used, and mixtures thereof with TAED can also be used. See also U.S. Pat. No. 4,634,551 for other typical conventional bleach activators. Also known are amido-derived bleach activators of the formulae: $R^1N(RS)C(O)R^2C(O)L$ or $R^1C(O)N(R^5)R^2C(O)L$ wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group other than an alpha-modified lactam. Further illustration of bleach activators of the above formulae include (6-octanamidocaproyl)oxybenzenesulfonate, (6-nonanamidocaproyl)oxybenzenesulfonate, (6-decanamido-caproyl)oxybenzenesulfonate, and mixtures thereof as described in U.S. Pat. No. 4,634,551. Another class of bleach activators comprises the benzoxazin-type activators disclosed by Hodge et al in U.S. Pat. No. 4,966,723, issued Oct. 30, 1990. Still another class of bleach activators includes acyl lactam activators such as octanoyl caprolactam, 3,5,5-trimethylhexanoyl caprolactam, nonanoyl caprolactam, decanoyl caprolactam, undecenoyl caprolactam, octanoyl valerolactam, decanoyl valerolactam, undecenoyl valerolactam, nonanoyl valerolactam, 3,5,5-trimethylhexanoyl valerolactam and mixtures thereof. The present compositions can optionally comprise acyl benzoates, such as phenyl benzoate. In general, noncationic bleach activators encompass hydrophilic types, such as TAED, and hydrophobic types, such as nonanoyloxybenzenesulfonate. As is disclosed hereinafter, it is preferred to complement the tea-stain removal system with a noncationic hydrophobic bleach activator.

(b) Organic Peroxides, especially Diacyl Peroxides—These are extensively illustrated in Kirk Othmer, Encyclopedia of Chemical Technology, Vol. 17, John Wiley and Sons, 1982 at pages 27–90 and especially at pages 63–72, all incorporated herein by reference. If a diacyl peroxide is used, it will preferably be one which exerts minimal adverse impact on spotting/filming. Dibenzoyl preoxide is acceptable, particularly when used a low levels, e.g., less than about 2% by weight of the automatic dishwashing detergent.

4. pH and Buffering Variation

Many detergent compositions herein will be buffered, i.e., they are relatively resistant to pH drop in the presence of acidic soils. However, other compositions herein may have exceptionally low buffering capacity, or may be substantially unbuffered. Techniques for controlling or varying pH at recommended usage levels more generally include the use of not only buffers, but also additional alkalis, acids, pH-jump systems, dual compartment containers, etc., and are well known to those skilled in the art.

The preferred ADD compositions herein comprise a pH-adjusting component selected from water-soluble alkaline inorganic salts and water-soluble organic or inorganic builders. The pH-adjusting components are selected so that when the ADD is dissolved in water at a concentration of 1,000–5,000 ppm, the pH remains in the range of above about 8, preferably from about 9.5 to about 11. The preferred non-phosphate pH-adjusting component of the invention is selected from the group consisting of:

(i) sodium carbonate or sesquicarbonate;

(ii) sodium silicate, preferably hydrous sodium silicate having $SiO_2$:$Na_2O$ ratio of from about 1:1 to about 2:1, and mixtures thereof with limited quantites of sodium metasilicate;

(iii) sodium citrate;

(iv) citric acid;

(v) sodium bicarbonate;

(vi) sodium borate, preferably borax;

(vii) sodium hydroxide; and (viii) mixtures of (i)–(vii).

Preferred embodiments contain low levels of silicate (i.e. from about 3% to about 10% $SiO_2$).

Illustrative of highly preferred pH-adjusting component systems are binary mixtures of granular sodium citrate with anhydrous sodium carbonate, and three-component mixtures of granular sodium citrate trihydrate, citric acid monohydrate and anhydrous sodium carbonate.

Preferred levels of sodium citrate (usually in the trisodium citrate dihydrate form) are in the range from about 1% to about 80% of the detergent composition.

The amount of the pH adjusting component in the instant ADD compositions is preferably from about 1% to about 50%, by weight of the composition. In a preferred embodiment, the pH-adjusting component is present in the ADD composition in an amount from about 5% to about 40%, preferably from about 5% to about 25%, by weight and is desirably in the form of sodium carbonate, sodium sesquicarbonate, sodium bicarbonate, or mixtures thereof.

For compositions herein having a pH between about 9.5 and about 11 of the initial wash solution, particularly preferred ADD embodiments comprise, by weight of ADD, from about 5% to about 40%, preferably from about 10% to about 30%, most preferably from about 15% to about 20%, of sodium citrate with from about 5% to about 30%, preferably from about 7% to 25%, most preferably from about 8% to about 20% sodium carbonate.

The essential pH-adjusting system can be complemented (i.e. for improved sequestration in hard water) by other optional detergency builder salts selected from nonphosphate detergency builders known in the art, which include the various water-soluble, alkali metal, ammonium or substituted ammonium borates, hydroxysulfonates, polyacetates, and polycarboxylates. Preferred are the alkali metal, especially sodium, salts of such materials. Alternate water-soluble, nonphosphorus organic builders can be used for their sequestering properties. Examples of polyacetate and polycarboxylate builders are the sodium, potassium, lithium, ammonium and substituted ammonium salts of ethylenediamine tetraacetic acid; nitrilotriacetic acid, tartrate monosuccinic acid, tartrate disuccinic acid, oxydisuccinic acid, carboxymethoxysuccinic acid, mellitic acid, and sodium benzene polycarboxylate salts.

(a) Water-Soluble Silicates

The present automatic dishwashing detergent compositions, in either phosphated or nonphosphated embodiments, may comprise water-soluble silicates, for example at levels of from 0% to about 25% by weight of the detergent composition. When present, levels of about 4% or above are typical. Water-soluble silicates herein are any silicates which are soluble to the extent that they do not adveresely affect spotting/filming characteristics of the ADD composition.

Examples of silicates are sodium metasilicate and, more generally, the alkali metal silicates, particularly those having a $SiO_2$:$Na_2O$ ratio in the range 1.6:1 to 3.2:1; and layered silicates, such as the layered sodium silicates described in U.S. Pat. No. 4,664,839, issued May 12, 1987 to H. P. Rieck. NaSKS-6® is a crystalline layered silicate marketed by Hoechst (commonly abbreviated herein as "SKS-6"). Unlike zeolite builders, NaSKS-6 and other water-soluble silicates usefule herein do not contain aluminum. NaSKS-6 is the $\delta$-$Na_2SiO_5$ form of layered silicate and can be prepared by methods such as those described in German DE-A-3,417,649 and DE-A-3,742,043. SKS-6 is a preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used. Various other layered silicates from Hoechst include NaSKS-5, NaSKS-7 and NaSKS-11, as the $\alpha$-, $\beta$- and $\gamma$-forms. Other silicates may also be useful, such as for example magnesium silicate, which can serve as a crispening agent in granular formulations, as a stabilizing agent for oxygen bleaches, and as a component of suds control systems.

Silicates particularly useful in automatic dishwashing (ADD) applications include granular hydrous 2-ratio silicates such as BRITESIL® $H_2O$ from PQ Corp., and the commonly sourced BRITESIL® H24 though liquid grades of various silicates can be used when the ADD composition has liquid form. Within safe limits, sodium metasilicate or sodium hydroxide alone or in combination with other silicates may be used in an ADD context to boost wash pH to a desired level.

5. Builders

Detergent builders other than silicates can optionally be included in the compositions herein to assist in controlling mineral hardness. Inorganic as well as organic builders can be used. Builders are typically used in automatic dishwashing and fabric laundering compositions, for example to assist in the removal of particulate soils.

The level of builder can vary widely depending upon the end use of the composition and its desired physical form. When present, the compositions will typically comprise at least about 1% builder. High performance compositions typically comprise from about 10% to about 80%, more typically from about 15% to about 50% by weight, of the detergent builder. Lower or higher levels of builder, however, are not excluded.

Inorganic or P-containing detergent builders include, but are not limited to, the alkali metal, ammonium and alkanolammonium salts of polyphosphates (exemplified by the tripolyphosphates, pyrophosphates, and glassy polymeric metaphosphates), phosphonates, phytic acid, silicates, carbonates (including bicarbonates and sesquicarbonates), sulfates, and aluminosilicates. However, non-phosphate builders are required in some locales. Compositions herein function surprisingly well even in the presence of "weak" builders (as compared with phosphates) such as citrate, or in the so-called "underbuilt" situation that may occur with zeolite or layered silicate builders. See U.S. Pat. No. 4,605,509 for examples of preferred aluminosilicates.

Examples of carbonate builders are the alkaline earth and alkali metal carbonates as disclosed in German Patent Application No. 2,321,001 published on Nov. 15, 1973. Various grades and types of sodium carbonate and sodium sesquicarbonate may be used, certain of which are particularly useful as carriers for other ingredients, especially detersive surfactants.

Aluminosilicate builders may be used in the present compositions though are not preferred for automatic dishwashing detergents. Aluminosilicate builders are of great importance in most currently marketed heavy duty granular detergent compositions, and can also be a significant builder ingredient in liquid detergent formulations. Aluminosilicate builders include those having the empirical formula: $NA_2O.AL_2O_3.xSiO_z.yH_2O$ wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In another embodiment, the crystalline aluminosilicate ion exchange material has the formula: $Na_{12}[(AlO_2)_{12}(SiO_2)_{12}].xH_2O$ wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter. Individual particles can desirably be even smaller than 0.1 micron to further assist kinetics of exchange through maximization of surface area. High surface area also increases utility of aluminosilicates as adsorbents for surfactants, especially in granular compositions. Aggregates of silicate or aluminosilicate particles may be useful, a single aggregate having dimensions tailored to minimize segregation in granular compositions, while the aggregate particle remains dispersible to submicron individual particles during the wash. As with other builders such as carbonates, it may be desirable to use zeolites in any physical or morphological form adapted to promote surfactant carrier function, and appropriate particle sizes may be freely selected by the formulator.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt or "overbased". When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr.7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediaminetetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty laundry detergent and automatic dishwashing formulations due to their availability from renewable resources and their biodegradability. Citrates can also be used in combination with zeolite, the aforementioned BKITESIL types, and/or layered silicate builders. Oxydisuccinates are also useful in such compositions and combinations.

Also suitable in the detergent compositions of the present invention are the 3,3-dicarboxy-4-oxa-1,6-hexanedionates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also U.S. Pat. No. 3,723,322.

Fatty acids, e.g., $C_{12}$–$C_{18}$ monocarboxylic acids, may also be incorporated into the compositions alone, or in combination with the aforesaid builders, especially citrate and/or the succinate builders, to provide additional builder activity but are generally not desired. Such use of fatty acids will generally result in a diminution of sudsing in laundry compositions, which may need to be be taken into account by the formulator. Fatty acids or their salts are undesirable in Automatic Dishwashing (ADD) embodiments in situations wherein soap scums can form and be deposited on dishware.

Where phosphorus-based builders can be used, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581;3,213,030; 3,422,021; 3,400,148 and 3,422,137) can also be used though such materials are more commonly used in a low-level mode as chelants or stabilizers.

6. Chelating Agents (Chelants)

The compositions herein may also optionally contain one or more transition-metal selective sequestrants, "chelants" or "chelating agents", e.g., iron and/or copper and/or manganese chelating agents. Typical levels, when present, are in the range from about 0.1% to about 2%, though higher levels can be used. Chelating agents suitable for use herein can be selected from the group consisting of aminocarboxylates, phosphonates (especially the aminophosphonates), polyfunctionally-substituted aromatic chelating agents, and mixtures thereof. Without intending to be bound by theory, it is believed that the benefit of these materials is due in part to their exceptional ability to control iron, copper and manganese in washing solutions; other benefits include inorganic film prevention or scale inhibition. Commercial chelating agents for use herein include the DEQUEST® series, and chelants from Monsanto, DuPont, and Nalco, Inc.

Aminocarboxylates useful as optional chelating agents are further illustrated by ethylenediaminetetracetates, N-hydroxyethyl-ethylenediaminetriacetates, nitrilotriacetates, ethylenediamine tetrapropionates, triethylenetetraaminehexacetates, diethylenetriamine-pentaacetates, ethanoldiglycines, and the alkali metal, ammonium, and substituted ammonium salts thereof. In general, chelant mixtures may be used for a combination of functions, such as multiple transition-metal control, long-term product stabilization, and/or control of precipitated transition metal oxides and/or hydroxides.

Polyfunctionally-substituted aromatic chelating agents are also useful in the compositions herein. See U.S. Pat No.

3,812,044, issued May 21, 1974, to Connor et al. Preferred compounds of this type in acid form are dihydroxydisulfobenzenes such as 1,2-dihydroxy-3,5-disulfobenzene.

A highly preferred biodegradable chelator for use herein is ethylenediamine disuccinate ("EDDS"), especially (but not limited to) the [S,S] isomer as described in U.S. Pat. No. 4,704,233, Nov. 3, 1987, to Hartman and Perkins. The trisodium salt is preferred though other forms, such as magnesium salts, may also be useful.

Aminophosphonates are also suitable for use as chelating agents in the compositions of the invention when at least low levels of total phosphorus are acceptable in detergent compositions, and include the ethylenediaminetetrakis (methylenephosphonates) and the diethylenetriaminepentakis (methylene phosphonates). Preferably, these aminophosphonates do not contain alkyl or alkenyl groups with more than about 6 carbon atoms.

If utilized, chelating agents or transition-metal-selective sequestrants will preferably comprise from about 0.001% to about 10%, more preferably from about 0.05% to about 1% by weight of the compositions herein.

7. Dispersant Polymer

Preferred ADD compositions herein may additionally contain a dispersant polymer. When present, a dispersant polymer in the instant ADD compositions is typically at levels in the range from 0 to about 25%, preferably from about 0.1% to about 20%, typically 0.1% to about 10%, more preferably from about 1% to about 8% by weight of the ADD composition. Dispersant polymers are useful for improved filming performance of the present ADD compositions, especially in higher pH embodiments, such as those in which wash pH exceeds about 9.5. Particularly preferred are polymers which inhibit the deposition of calcium carbonate or magnesium silicate on dishware.

Dispersant polymers suitable for use herein are further illustrated by the film-forming polymers described in U.S. Pat. No. 4,379,080 (Murphy), issued Apr. 5, 1983.

Suitable polymers are preferably at least partially neutralized or alkali metal, ammonium or substituted ammonium (e.g., mono-, di- or triethanolammonium) salts of polycarboxylic acids. The alkali metal, especially sodium salts are most preferred. While the molecular weight of the polymer can vary over a wide range, it preferably is from about 1,000 to about 500,000, more preferably is from about 1,000 to about 250,000, and most preferably, especially if the ADD is for use in Noah American automatic dishwashing appliances, is from about 1,000 to about 5,000.

Other suitable dispersant polymers include those disclosed in U.S. Pat. No. 3,308,067 issued Mar. 7, 1967, to Diehl. Unsaturated monomeric acids that can be polymerized to form suitable dispersant polymers include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as methyl vinyl ether, styrene, ethylene, etc. is suitable provided that such segments do not constitute more than about 50% by weight of the dispersant polymer.

Copolymers of acrylamide and acrylate having a molecular weight of from about 3,000 to about 100,000, preferably from about 4,000 to about 20,000, and an acrylamide content of less than about 50%, preferably less than about 20%, by weight of the dispersant polymer can also be used. Most preferably, such dispersant polymer has a molecular weight of from about 4,000 to about 20,000 and an acrylamide content of from about 0% to about 15%, by weight of the polymer.

Particularly preferred dispersant polymers are low molecular weight modified polyacrylate copolymers. Such copolymers contain as monomer units: a) from about 90% to about 10%, preferably from about 80% to about 20% by weight acrylic acid or its salts and b) from about 10% to about 90%, preferably from about 20% to about 80% by weight of a substituted acrylic monomer or its salt and have the general formula: $-[(C(R^2)C(R^1)(C(O)OR^3)]$ wherein the apparently unfilled valencies are in fact occupied by hydrogen and at least one of the substituents $R^1$, $R^2$, or $R^3$, preferably $R^1$ or $R^2$, is a 1 to 4 carbon alkyl or hydroxyalkyl group; $R^1$ or $R^2$ can be a hydrogen and $R^3$ can be a hydrogen or alkali metal salt. Most preferred is a substituted acrylic monomer wherein $R^1$ is methyl, $R^2$ is hydrogen, and $R^3$ is sodium.

Suitable low molecular weight polyacrylate dispersant polymer preferably has a molecular weight of less than about 15,000, preferably from about 500 to about 10,000, most preferably from about 1,000 to about 5,000. The most preferred polyacrylate copolymer for use herein has a molecular weight of about 3,500 and is the fully neutralized form of the polymer comprising about 70% by weight acrylic acid and about 30% by weight methacrylic acid.

Other suitable modified polyacrylate copolymers include the low molecular weight copolymers of unsaturated aliphatic carboxylic acids disclosed in U.S. Pat. Nos. 4,530,766, and 5,084,535.

Agglomerated forms of the present ADD compositions may employ aqueous is solutions of polymer dispersants as liquid binders for making the agglomerate (particularly when the composition consists of a mixture of sodium citrate and sodium carbonate). Especially preferred are polyacrylates with an average molecular weight of from about 1,000 to about 10,000, and acrylate/maleate or acrylate/fumarate copolymers with an average molecular weight of from about 2,000 to about 80,000 and a ratio of acrylate to maleate or fumarate segments of from about 30:1 to about 1:2. Examples of such copolymers based on a mixture of unsaturated mono- and dicarboxylate monomers are disclosed in European Patent Application No. 66,915, published Dec. 15, 1982.

Other dispersant polymers useful herein include the polyethylene glycols and polypropylene glycols having a molecular weight of from about 950 to about 30,000 which can be obtained from the Dow Chemical Company of Midland, Mich. Such compounds for example, having a melting point within the range of from about 30° C. to about 100° C., can be obtained at molecular weights of 1,450, 3,400, 4,500, 6,000, 7,400, 9,500, and 20,000. Such compounds are formed by the polymerization of ethylene glycol or propylene glycol with the requisite number of moles of ethylene or propylene oxide to provide the desired molecular weight and melting point of the respective polyethylene glycol and polypropylene glycol. The polyethylene, polypropylene and mixed glycols are referred to using the formula:

$$HO(CH_2CH_2O)_m(CH_2CH(CH_3)O)_n(CH(CH_3)CH_2O)_oOH$$

wherein m, n, and o are integers satisfying the molecular weight and temperature requirements given above.

Yet other dispersant polymers useful herein include the cellulose sulfate esters such as cellulose acetate sulfate, cellulose sulfate, hydroxyethyl cellulose sulfate, methylcellulose sulfate, and hydroxypropylcellulose sulfate. Sodium cellulose sulfate is the most preferred polymer of this group.

Other suitable dispersant polymers are the carboxylated polysaccharides, particularly starches, celluloses and alginates, described in U.S. Pat. No. 3,723,322, Diehl, issued Mar. 27, 1973; the dextrin esters of polycarboxylic acids disclosed in U.S. Pat. No. 3,929,107, Thompson, issued Nov. 11, 1975; the hydroxyalkyl starch ethers, starch esters, oxidized starches, dextrins and starch hydrolysates described in U.S. Pat No. 3,803,285, Jensen, issued Apr. 9, 1974; the carboxylated starches described in U.S. Pat. No.

3,629,121, Eldib, issued Dec. 21, 1971; and the dextrin starches described in U.S. Pat. No. 4,141,841, McDonald, issued Feb. 27, 1979. Preferred cellulose-derived dispersant polymers are the carboxymethyl celluloses.

Yet another group of acceptable dispersants are the organic dispersant polymers, such as polyaspartate.

8. Material Care Agents

The present ADD compositions may contain one or more material care agents which are effective as corrosion inhibitors and/or anti-tarnish aids. Such materials are preferred components of machine dishwashing compositions especially in certain European countries where the use of electroplated nickel silver and sterling silver is still comparatively common in domestic flatware, or when aluminium protection is a concern and the composition is low in silicate. Generally, such material care agents include metasilicate, silicate, bismuth salts, manganese salts, paraffin, triazoles, pyrazoles, thiols, mercaptans, aluminium fatty acid salts, and mixtures thereof.

When present, such protecting materials are preferably incorporated at low levels, e.g., from about 0.01% to about 5% of the ADD composition. Suitable corrosion inhibitors include paraffin oil, typically a predominantly branched aliphatic hydrocarbon having a number of carbon atoms in the range of from about 20 to about 50; preferred paraffin oil is selected from predominantly branched $C_{25-45}$ species with a ratio of cyclic to noncyclic hydrocarbons of about 32:68. A paraffin oil meeting those characteristics is sold by Wintershall, Salzbergen, Germany, under the trade name WINOG 70. Additionally, the addition of low levels of bismuth nitrate (i.e., $Bi(NO_3)_3$) is also preferred.

Other corrosion inhibitor compounds include benzotriazole and comparable compounds; mercaptans or thiols including thionaphthol and thioanthranol; and finely divided Aluminium fatty acid salts, such as aluminium tristearate. The formulator will recognize that such materials will generally be used judiciously and in limited quantities so as to avoid any tendency to produce spots or films on glassware or to compromise the bleaching action of the compositions. For this reason, mercaptan anti-tarnishes which are quite strongly bleach-reactive and common fatty carboxylic acids which precipitate with calcium in particular are preferably avoided.

9. Silicone and Phosphate Ester Suds Suppressors

The ADD's of the invention can optionally contain an alkyl phosphate ester suds suppressor, a silicone suds suppressor, or combinations thereof. Levels in general are from 0% to about 10%, preferably, from about 0.001% to about 5%. Typical levels tend to be low, e.g., from about 0.01% to about 3% when a silicone suds suppressor is used. Preferred non-phosphate compositions omit the phosphate ester component entirely.

Silicone suds suppressor technology and other defoaming agents useful herein are extensively documented in "Defoaming, Theory and Industrial Applications", Ed., P. R. Garrett, Marcel Dekker, New York, 1973, ISBN 0-8247-8770-6, incorporated herein by reference. See especially the chapters entitled "Foam control in Detergent Products" (Ferch et al) and "Surfactant Antifoams" (Blease et al). See also U.S. Pat. Nos. 3,933,672 and 4,136,045. Highly preferred silicone suds suppressors are the compounded types known for use in laundry detergents such as heavy-duty granules, although types hitherto used only in heavy-duty liquid detergents may also be incorporated in the instant compositions. For example, polydimethylsiloxanes having trimethylsilyl or alternate endblocking units may be used as the silicone. These may be compounded with silica and/or with surface-active nonsilicon components, as illustrated by a suds suppressor comprising 12% silicone/silica, 18% stearyl alcohol and 70% starch in granular form. A suitable commercial source of the silicone active compounds is Dow Corning Corp.

Levels of the suds suppressor depend to some extent on the sudsing tendency of the composition, for example, an ADD for use at 2000 ppm comprising 2% octadecyldimethylamine oxide may not require the presence of a suds suppressor. Indeed, it is an advantage of the present invention to select cleaning-effective amine oxides which are inherently much lower in foam-forming tendencies than the typical coco amine oxides. In contrast, formulations in which amine oxide is combined with a high-foaming anionic cosurfactant, e.g., alkyl ethoxy sulfate, benefit greatly from the presence of suds suppressor.

Phosphate esters have also been asserted to provide some protection of silver and silver-plated utensil surfaces; however, the instant compositions can have excellent silvercare without a phosphate ester component. Without being limited by theory, it is believed that lower pH formulations, e.g., those having pH of 9.5 and below, plus the presence of the low level amine oxide, both contribute to improved silver care.

If it is desired nonetheless to use a phosphate ester, suitable compounds are disclosed in U.S. Pat. No. 3,314,891, issued Apr. 18, 1967, to Schmolka et al, incorporated herein by reference. Preferred alkyl phosphate esters contain from 16–20 carbon atoms. Highly preferred alkyl phosphate esters are monostearyl acid phosphate or monooleyl acid phosphate, or salts thereof, particularly alkali metal salts, or mixtures thereof.

It has been found preferable to avoid the use of simple calcium-precipitating soaps as antifoams in the present compositions as they tend to deposit on the dishware. Indeed, phosphate esters are not entirely free of such problems and the formulator will generally choose to minimize the content of potentially depositing antifoams in the instant compositions.

10. Other Optional Adjuncts

Depending on whether a greater or lesser degree of compactness is required, filler materials can also be present in the instant ADDs. These include sucrose, sucrose esters, sodium sulfate, potassium sulfate, etc., in amounts up to about 70%, preferably from 0% to about 40% of the ADD composition. Preferred filler is sodium sulfate, especially in good grades having at most low levels of trace impurities.

Sodium sulfate used herein preferably has a purity sufficient to ensure it is non-reactive with bleach; it may also be treated with low levels of sequestrants, such as phosphonates or EDDS in magnesium-salt form. Note that preferences, in terms of purity sufficient to avoid decomposing bleach, applies also to pH-adjusting component ingredients, specifically including any silicates used herein.

Although optionally present in the instant compositions, the present invention encompasses embodiments which are substantially free from sodium chloride or potassium chloride.

Hydrotrope materials such as sodium benzene sulfonate, sodium toluene sulfonate, sodium cumene sulfonate, etc., can be present, e.g., for better dispersing surfactant.

Bleach-stable perfumes (stable as to odor); and bleach-stable dyes such as those disclosed in U.S. Pat. No. 4,714,562, Roselle et al, issued Dec. 22, 1987 can also be added to the present compositions in appropriate amounts. Other common detergent ingredients consistent with the spirit and scope of the present invention are not excluded.

Since ADD compositions herein can contain water-sensitive ingredients or ingredients which can co-react when brought together in an aqueous environment, it is desirable to keep the free moisture content of the ADDs at a minimum, e.g., 7% or less, preferably 4% or less of the ADD; and to provide packaging which is substantially impermeable to water and carbon dioxide. Coating measures have been described herein to illustrate a way to protect the ingredients from each other and from air and moisture. Plastic bottles, including refillable or recyclable types, as well as conventional barrier cartons or boxes are another helpful means of assuring maximum shelf-storage stability. As noted, when ingredients are not highly compatible, it may further be desirable to coat at least one such ingredient with a low-foaming nonionic surfactant for protection. There are numerous waxy materials which can readily be used to form suitable coated particles of any such otherwise incompatible components; however, the formulator prefers those materials which do not have a marked tendency to deposit or form films on dishes including those of plastic construction.

Method for Cleaning:

The present invention also encompasses a method for cleaning soiled tableware comprising contacting said tableware with an aqueous medium comprising the above-defined tea stain removal system, preferably at a concentration of from about 10 ppm to about 500 ppm. Preferred aqueous media have an initial pH in a wash solution of above about 8, more preferably from about 9.5 to about 12, most preferably from about 9.5 to about 10.5.

The present invention is not intended to be limited in terms of mode of automatic dishwashing use; as such, it can be used in the rinse cycle of an automatic dishwasher or in an institutional dishwashing machine.

As noted in summary, a transition-metal bleach catalyst can be added to the instant compositions. Particularly suitable cobalt bleach catalysts are not known to be commercial but can be made as follows:

Synthesis Methods for Cobalt Catalysts:

Suitable cobalt bleach catalysts having carboxylate ligands may be made by the following synthesis methods which are illustrated for preferred catalysts $[Co(NH_3)_5OAc]Cl_2$ and $[CoCNH_3)_5OAc](OAc)_2$. Other preferred catalysts include $[Co(NH_3)_5OAc](PF_6)_2$; $[Co(NH_3)_5OAc](SO_4)$; and $[Co(NH_3)_5OAc](BF_4)_2$.

Synthesis of $[Co(NH_3)_5OAc]Cl_2$.

Synthesis Example 1:

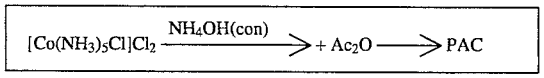

$[Co(NH_3)_5Cl]Cl_2$ (26.4 g, 0.10 mol) is added to distilled water (800 mL). $NH_4OH$ (23.4 mL, 0.600 mol) is slowly added with stirring. The solution is then heated to 75° C. and the solid dissolves with stirring. The solution is cooled to RT. Acetic anhydride (30.6 g, 0.30 mol) is slowly added with stirring. The solution is stirred 1 hour at RT. At this point the reaction solution can either be lyophilized to a pink powder or the solution can be rotovapped down and the resulting solid pumped on overnight at 0.05 mm. to remove residual water and $NH_4OAc$. The excess ammonium acetate and ammonium chloride salts can also be removed by washing the solid with ethanol. Yield 35 gr., 78.1% by uv-vis spectroscopy. HPLC [according to the method of D. A. Buckingham, et al, *Inorg. Chem.*, 28, 4567–4574 (1989)] shows all of the cobalt is present as $[Co(NH_3)_5OAc]Cl_2$.

Synthesis Example 2:

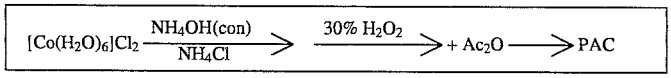

$NH_4Cl$ (25.0 g) is dissolved in $NH_4OH$ (150 mL). $[Co(H_2O)_6]Cl_2$ (26.4 g, 0.10 mol) is added to this solution forming a slurry. $H_2O_2$ (30%, 40.0 mL) is slowly dripped into the solution with stirring. Acetic anhydride (30.6 g, 0.30 mol) is slowly added with stirring. The solution is stirred 1 hour at RT. At this point the reaction solution can either be lyophilized to a pink powder or the solution can be rotovapped down and the resulting solid pumped on overnight at 0.05 min. to remove residual water and $NH_4OAc$. The excess ammonium acetate and ammonium chloride salts can also be removed by washing the solid with ethanol. Yield 35 gr., 78.1% by uv-vis spectroscopy. HPLC [according to the method of D. A. Buckingham, et al, *Inorg. Chem.*, 28, 4567–4574 (1989)] shows all of the cobalt is present as $[Co(NH_3)_5OAc]Cl_2$.

Synthesis Example 3:

Ammonium hydroxide (4498.0 mL, 32.3 mol, 28%) and ammonium chloride (749.8 g, 14.0 mol) are combined in a 12 L three-necked round-bottomed flask fitted with a condenser, internal thermometer, mechanical stirrer, and addition funnel. Once the mixture becomes homogeneous, cobalt(II) chloride hexahydrate (1500.0 g, 6.3 mol) is added in portions over 5 min forming a slurry. The reaction mixture warms to 50° C. and takes on a muddy color. $H_2O_2$ (429.0 g, 6.3 mol, 50%) is added over 30 min. The mixture becomes deep red and homogeneous and the temperature raises to 60°–65° C. during addition of the peroxide. Ammonium acetate (485.9 g, 6.3 mol) is then added to the mixture 30 min later. After stirring an additional 15 min, acetic anhydride (2242.5 g, 22.1 mol) is added over 1 h. The anhydride is added so as to keep the reaction temperature below 75° C. The mixture is stirred for 2 h as it cools. The red mixture is filtered and the filtrate treated with isopropanol until an orange-pink solid forms. The solid is collected, washed with isopropanol, ether, and dried to give an orange-pink solid. UV-Vis measurements indicate the product to be 95.3% pure as $[Co(NH_3)_5OAc]Cl_2$.

Synthesis of $[Co(NH_3)_5OAc](OAc)_2$.

Ammonium hydroxide (286.0 mL, 2.06 mol, 28%) and ammonium acetate (68.81 g, 0.89 mol) are combined in a 1000 mL three-necked round-bottomed flask fitted with a condenser, internal thermometer, mechanical stirrer, and addition funnel. Once the mixture becomes homogeneous, cobalt(II) acetate tetrahydrate (100.00 g, 0.40 mol) is added in portions over 5 min. The mixture becomes black and warms to 31° C. The mixture is treated with $H_2O_2$ (27.32 g, 0.40 mol, 50%) dropwise over 15 min. The mixture further exotherms to 53° C. and turns deep red once addition is complete. After stirring for 1 h, HPLC analysis indicates that all of the cobalt is present as $[Co(NH_3)_5OAc](OAc)_2$. Concentration yields the desired complex as a red solid.

Synthesis of $[Co(NH_3)_5OAc](PF_6)_2$

The $[Co(NH_3)_5OAc](OAc)_2$ product of the preceeding example is treated with 1 equivalent of $NaPF_6$ in water at room temperature. The reaction mixture is stirred for one 1 h, concentrated to a viscous liquid, and cooled to 10°–15° C. Red crystals precipitate from the mixture and are collected by filtration. HPLC analysis of the red product indicates all of the cobalt is present as $[Co(NH_3)_5OAc](PF_6)_2$.

Process for making Automatic Dishwashing Detergents

Although the art includes processes which rely on dry-mixing or spray-drying ingredients, such processes are not preferred herein as they generally produce products with low density or high tendency to segregate in the package. Desirably for the present purposes, automatic dishwashing compositions can be made by a process comprising two essential stages: mixing/drying wet-and-dry ingredients, optionally including molten-form surfactants, to form particles having granulometry generally appropriate for the intended use; and mixing free-flowing, relatively dry components, of compatible granulometry, with the product of the first stage. The latter mixing stage is, of course, necessary since bleach-active salts such as monopersulfate and enzyme prills are not tolerant of the wet-stage processing.

As compared with the known processes for making granular automatic dishwashing detergents with oxygen bleach, preferred embodiments of this invention typically will be made by a process comprising: (a) in the presence of water, forming a fluid premix consisting essentially of an organic dispersant and a bleach stabilizer; (b) one or more mixing/drying steps wherein the fluid premix is contacted with solid-form water-soluble nonphosphorus salts, very preferably, by means of conventional agglomeration and fluidized-bed drying equipment, sequentially; and (c) addition of bleach-active salts including cationic bleach activator. Optionally, additional sprayons or additions of other components such as perfumes, and the like, can be performed. Particularly desirable options which can be accommodated are illustrated by (i) inclusion of perfume in the step (a) premix; (ii) inclusion of fluid-form surfactant in step (b) and (iii) inclusion of hydrous silicates in step (c). Other optional adjuncts can also, in general, be added in steps (a), (b) or (c). Minors, e.g., perfume and colorants, typically comprise less than about 3% of the finished formula.

Limitation of Ingredients in Certain Preferred Embodiments

The present composition encompasses automatic dishwashing detergent embodiments which are essentially free of inorganic phosphate builders, such as sodium tripolyphosphate. "Essentially free" is defined as less than about 1%, by weight of the composition, preferably less than about 0.5%, by weight of the composition.

The invention likewise encompasses embodiments which are essentially free of chlorine bleach, such as sodium hypochlorite. "Essentially free" is defined as less than about 1%, preferably less than about 0.5%, by weight of the composition. Most preferably, the level of added chlorine bleach is 0%.

The present invention includes ADD embodiments which are essentially free of soluble chloride, such as sodium chloride. "Essentially free" is defined as less than about 1%, preferably less than about 0.5%, more preferably still, less than about 0.1% by weight of the composition.

The present invention further has ADD embodiments which are essentially free of soluble bromide, such as potassium bromide. "Essentially free" is defined as less than about 1%, preferably less than about 0.01%, by weight of the composition.

The present invention also has embodiments which are essentially free of soap, such as $C_{18}$ fatty acid or sodium salt thereof. "Essentially free" is defined as less than about 1%, preferably less than about 0.1%, by weight of the composition.

While the invention includes embodiments in which one or more transition-metal containing bleach catalysts may be incorporated, embodiments are also envisaged which are essentially free of added transition metals or transition metal complexes of any type. "Essentially free" in this context is defined as less than about 0.1%, preferably less than about 0.01% by weight of the composition.

Moreover the present invention has embodiments which are essentially free of all of the foregoing ingredients listed in this section. "Essentially free" is defined as less than about 1%, preferably less than about 0.1%, by weight of the composition for the sum of the above ingredients.

The following nonlimiting examples further illustrate ADD compositions of the present invention.

EXAMPLE I

An ADD composition whose compactness is 60% that of conventional ADD compositions (i.e., 40% reduction in usage levels) is as follows. The composition is designed for use at about 23.4 g per wash cycle (3,600 ppm in wash water).

| Ingredient | % (wt.) | |
|---|---|---|
| Sodium Perborate Monohydrate | 13.2 | (2.0% AvO) |
| OXONE[6] | 7.7 | (0.35% AvO) |
| Cationic Bleach Activator A | 3.5 | |
| Trisodium citrate[1] | 13 | |
| Sodium carbonate (anhydrous basis) | 17 | |
| Silicate (2.0 ratio)[2] | 8 | |
| Nonionic surfactant[3] | 4.3 | |
| Sodium polyacrylate (m.w. 4,000)[4] | 5.0 | |
| DTPA[5] | 0.83 | |
| TERMAMYL 60 T prill[7] | 2.78 | |
| SAVINASE 6.0 T prill[8] | 1.67 | |
| $Na_2SO_4/H_2O$/minors[9] | Balance | |

[1]Trisodium citrate dihydrate, expressed on anhydrous basis.
[2]BRITESIL H20, PQ Corp., expressed on anhydrous basis.
[3]$C_{18}E_{7.9}$ blend with reverse PO-20EO-PO block copolymer and monostearyl acid phosphate at a weight ratio of about 39:60:1.
[4]ACCUSOL, Rohm & Haas.
[5]Diethylenetriamine pentaacetate, pentasodium salt, anhydrous basis.
[6]The first number quoted being percentage by weight of commercial-grade OXONE in the composition.
[7]Approximate prill content of active enzyme = 2.5%, dry basis.
[8]Approximate prill content of active enzyme = 1.5%, dry basis.
[9]Maximum 8% wt. $H_2O$ in composition.

Cationic Bleach Activator A is:

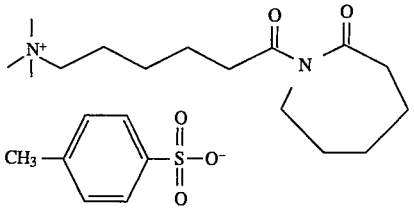

EXAMPLE II

An ADD composition whose compactness is 50% that of conventional ADD compositions (i.e., 50% reduction in usage levels) is as follows. The composition is designed for use at about 19.5 g per wash cycle (3,000 ppm in wash water).

| Ingredient | % (wt.) | |
|---|---|---|
| Sodium Percarbonate | 13.2 | (2.0% AvO) |
| OXONE[6] | 2.2 | (0.1% AvO) |
| Cationic Bleach Activator B | 3.5 | |
| Trisodium citrate[1] | 15 | |
| Sodium carbonate (anhydrous basis) | 20 | |
| Silicate (2.0 ratio)[2] | 21.4 | |
| Nonionic surfactant[3] | 3.5 | |
| Sodium polyacrylate (m.w. 4,000)[4] | 5.3 | |
| DTPA[5] | 2.44 | |
| TERMAMYL 60 T prill | 1.1 | |
| SAVINASE 6.0 T prill | 3.0 | |
| $H_2O$/minors[6] | Balance | |

[1]Trisodium citrate dihydrate, expressed on anhydrous basis.
[2]BRITESIL H20, PQ Corp., expressed on anhydrous basis.
[3]$C_{18}E_{7.9}$ blend with block copolymer, as in Example I.
[4]ACCUSOL, Rohm & Haas.
[5]Diethylenetriamine pentaacetate, pentasodium salt, anhydrous basis.
[6]Maximum 8.5% wt. H2O in composition.

EXAMPLE III

An ADD composition whose compactness is 50% that of conventional ADD compositions (i.e., 50% reduction in usage levels) is as follows. The composition is designed for use at about 19.5 g per wash cycle (3,000 ppm in wash water).

| Ingredient | % (wt.) | |
|---|---|---|
| Sodium Perborate Monohydrate | 9.9 | (1.5% AvO) |
| OXONE (% Av 0)[6] | 4.9 | (0.22% AvO) |
| Cationic Bleach Activator B | 2.0 | |
| Trisodium citrate[1] | 10 | |
| Sodium carbonate | 20 | |
| Silicate (2.0 ratio)[2] | 21 | |
| Nonionic surfactant[3] | 3.5 | |
| Sodium polyacrylate (m.w. 4,000)[4] | 5.3 | |
| DTPA[5] | 2.44 | |
| SAVINASE 6.0 T prill | 1.6 | |
| $Na_2SO_4/H_2O$/minors[6] | Balance | |

[1]Trisodium citrate dihydrate, expressed on anhydrous basis.
[2]BRITESIL H20, PQ Corp., expressed on anhydrous basis.
[3]C18E7.9.
[4]ACCUSOL, Rohm & Haas.
[5]Diethylenetriamine pentaacetate, pentasodium salt.
[6]Maximum 7.5% wt. $H_2O$ in composition.

EXAMPLE IV

A teapot cleaner is prepared by mixing:

| Ingredient | % (wt.) | |
|---|---|---|
| Sodium Perborate Monohydrate | 26.5 | (4.0% AvO) |
| OXONE[6] | 4.9 | (0.22% AvO) |
| Cationic Bleach Activator A | 2.0 | |
| Trisodium citrate[1] | 10 | |
| Sodium carbonate | 20 | |
| Silicate (2.0 ratio)[2] | 3 | |
| Nonionic surfactant[3] | 0.5 | |
| Sodium polyacrylate (m.w. 4,000)[4] | 8 | |
| DTPA[5] | 5 | |
| $Na_2SO_4/H_2O$/minors[6] | Balance | |

The composition is dissolved in warm water at a temperature of about 20 deg. C to about 40 deg. C and a concentration of about 0.5% to about 10% and is used to soak tea-stained porcelain teapots, with excellent results.

EXAMPLE V

The following automatic dishwashing detergent compositions are prepared by mixing:

| INGREDIENTS | A wt % | B wt % | C wt % | D wt % |
|---|---|---|---|---|
| OXONE (R) (weight basis) | 4.9 | 4.9 | 0 | 0 |
| Tetrabutylammonium monopersulfate (weight basis) | 0 | 0 | 0.5 | 1 |
| Sodium Perborate Monohydrate (weight basis) | 13 | 0 | 7 | 10 |
| Sodium Percarbonate (weight basis) | 0 | 13 | 0 | 2 |
| Cationic Bleach Activator A, B, B2 or C (weight basis) | 3 | 2 | 1 | 2 |
| Silicate: BRITESIL H2O ®, PQ Corp. (as $SiO_2$) | 9 | 7 | 8 | 9 |
| Low Foaming Nonionic Surfactant[10] | 3 | 1 | 1 | 2 |
| Polymeric Dispersant[11] | 7 | 8 | 3 | 5 |
| Chelant: Hydroxyethyldiphosphonate (HEDP), Na Salt | 0.5 | 0.1 | 0.5 | 0.5 |
| Chelant: Ethylenediamine Disuccinate, Trisodium Salt | 0 | 0.5 | 0.1 | 0 |
| Chelant: Diethylenetriaminepentaacetic acid, Penta-Na | 0 | 0.3 | 0 | 0.1 |
| Builder: Trisodium Citrate Dihydrate (anhydrous basis) | 8 | 12 | 10 | 15 |
| Builder: Sodium Carbonate (anhydrous basis) | 20 | 20 | 10 | 15 |
| Detersive Enzyme: Savinase ® 6T (0.3 Au/g) | 3 | 2 | 3 | 1 |
| Detersive Enzyme: Termamyl ® 60T (600 AMU/g) | 1 | 1 | 0 | 1 |
| Sodium Sulfate, water, minors - Balance to: | 100 | 100 | 100 | 100 |

[10]SLF18 ®, Olin Corp. or LF404 ®, BASF.
[11]One or more of: Sokolan PA30 ®, BASF or Accusol 480N ®, Rohm & Haas.

The ADD compositions have compactness which is 50% that of conventional ADD compositions (i.e., 50% reduction in usage levels). The compositions are designed for use at about 19.5 g per wash cycle (3,000 ppm in wash water).

EXAMPLE VI

The following automatic dishwashing detergent compositions are prepared by mixing:

| INGREDIENTS | A wt % | B wt % | C wt % | D wt % |
|---|---|---|---|---|
| OXONE (R) (weight basis) | 4.9 | 4.9 | 0 | 0 |
| Tetrabutylammonium monopersulfate (weight basis) | 0 | 0 | 2 | 0 |
| Dioctyldimethlyammonium monopersulfate (weight basis) | 0 | 0 | 0 | 1 |
| Dimethyl dihydrogenated tallow ammonium monopersulfate | 0 | 0 | 0 | 0.5 |
| Sodium Perborate Monohydrate (weight basis) | 13 | 0 | 10 | 10 |
| Sodium Percarbonate (weight basis) | 0 | 13 | 0 | 2 |
| Cationic Bleach Activator A (weight Basis) | 0.5 | 1 | 2 | 3 |
| Dibenzoyl Peroxide | 0 | 0 | 1 | 0 |
| Phenyl Benzoate | 1 | 0 | 0 | 0 |
| Perbenzoic acid | 0 | 1 | 0 | 0 |
| Silicate: BRITESIL H2O ®, PQ Corp. (as $SiO_2$) | 9 | 7 | 8 | 9 |
| Low Foaming Nonionic Surfactant[10] | 3 | 1 | 1 | 2 |
| Polymeric Dispersant[11] | 7 | 8 | 3 | 5 |
| Chelant: Hydroxyethyldiphosphonate (HEDP), Na Salt | 0.5 | 0.1 | 0.5 | 0.5 |
| Chelant: Ethylenediamine Disuccinate, Trisodium Salt | 0 | 0.5 | 0.1 | 0 |
| Chelant: Diethylenetriaminepentaacetic acid, Pentasodium | 0 | 0.3 | 0 | 0.1 |
| Builder: Trisodium Citrate Dihydrate (anhydrous basis) | 8 | 12 | 10 | 15 |
| Builder: Sodium Carbonate (anhydrous basis) | 20 | 20 | 10 | 15 |
| Detersive Enzyme: Savinase ® 6T (0.3 Au/g) | 3 | 2 | 3 | 1 |
| Detersive Enzyme: Termamyl ® 60T (600 AMU/g) | 1 | 1 | 0 | 1 |
| Sodium Sulfate, water, minors - Balance to: | 100 | 100 | 100 | 100 |

[10]defined above
[11]defined above

The ADD compositions have compactness which is 50% that of conventional ADD compositions (i.e., 50% reduction in usage levels). The compositions are designed for use at about 19.5 g per wash cycle (3,000 ppm in wash water). The ADD's of the above dishwashing detergent composition examples are used to wash tea-stained cups, starch-soiled and spaghetti-soiled dishes, milk-soiled glasses, starch, cheese, egg or babyfood-soiled flatware, and tomato-stained plastic spatulas by loading the soiled dishes in a domestic automatic dishwashing appliance and washing using either cold fill, 60° C. peak, or uniformly 45°–50° C. wash cycles with a product concentration of the exemplary compositions of from about 1,000 to about 5,000 ppm, with excellent results.

EXAMPLE VII

| INGREDIENT | 7A wt % | 7B wt % | 7C wt % |
|---|---|---|---|
| Cobalt Catalyst (See Note 2) | 0 | 0 | 0.1 |
| Sodium Perborate Monohydrate (See Note 3) | 1.5 | 2.0 | 1.0 |
| OXONE (weight basis) | 4.9 | 4.9 | 4.9 |
| Cationic Bleach Activator A | 2 | 0.5 | 1.5 |
| Sodium Percarbonate (See Note 3) | 0 | 1.0 | 1.2 |
| Amylase (QL37 + M197T as 3% active protein, NOVO) | 2 | 1.5 | 1 |
| Dibenzoyl Peroxide | 0 | 0.5 | 0 |
| Bleach Activator (TAED or NOBS) | 0.5 | 0 | 0 |
| Protease 1 (SAVINASE 12 T, 3.6% active protein) | 2.5 | 0 | 0 |
| Protease 2 (Protease D, as 4% active protein) | 0 | 1 | 1 |
| Trisodium Citrate Dihydrate (anhydrous basis) | 15 | 15 | 15 |
| Sodium Carbonate, anhydrous | 20 | 20 | 20 |
| BRITESIL H2O, PQ Corp. (as $SiO_2$) | 7 | 7 | 17 |
| Sodium Metasilicate Pentahydrate, (as $SiO_2$) | 3 | 0 | 0 |
| Diethylenetriaminepentaacetic Acid, Sodium Salt | 0 | 0.1 | 0 |
| Diethylenetriaminepenta(methylenephosphonic acid), Sodium Salt | 0.1 | 0 | 0.1 |
| Hydroxyethyldiphosphonate (HEDP), Sodium Salt | 0.5 | 0 | 0.5 |
| Dispersant Polymer (See Note 1) | 6 | 5 | 6 |
| Nonionic Surfactant (SLF18, Olin Corp. or LF404, BASF) | 2 | 2 | 3 |
| Sodium Sulfate, water, minors | Balance to 100% | Balance to 100% | Balance to 100% |

Note 1: Dispersant Polymer: One or more of: Sokolan PA30, BASF Corp., Accusol 480N, Rohm & Haas.
Note 2: $[Co(NH_3)_5OAc]Cl_2$, prepared according to the synthesis examples hereinbefore.
Note 3: These Hydrogen Peroxide Sources are expressed on an available oxygen basis. To convert to a basis of percentage of the total composition, divide by 0.15

The ADD's of the above dishwashing detergent composition example is used to wash tea-stained cups, starch-soiled and spaghetti-soiled dishes, milk-soiled glasses, starch, cheese, egg or babyfood- soiled flatware, and tomato-stained plastic spatulas by loading the soiled dishes in a domestic automatic dishwashing appliance and washing using either cold fill, 60° C. peak, or uniformly 45°–50° C. wash cycles with a product concentration of the exemplary compositions of from about 1,000 to about 5,000 ppm, with excellent results.

The foregoing examples are illustrative and are not intended to be limiting of the invention. Thus, while granular compositions for domestic automatic dishwashing are the preferred form of composition, granular products for use in institutional dishwashing are equally encompassed.

What is claimed is:

1. A detergent composition comprising:

(a) from about 0.02% to about 2.5%, on an available oxygen basis, of one or more monopersulfate salts;

(b) from about 0.1% to about 4% on an available oxygen basis, of one or more hydrogen peroxide releasing salts; and (c) from about 0.1% to about 10% by weight of one or more cationic bleach activators selected from the group consisting of:

(i) monocationic bleach activator having the formula:

$$((CH_3)_3N^+(CH_2)_{3\text{-}8}C(O)L)\ (Z)^-$$

where L is caprolactam and (ii) tricationic bleach activator having the formula:

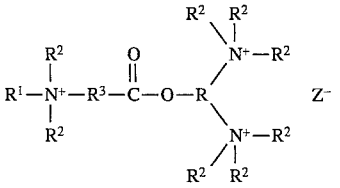

wherein $R^1$ is $C_1$–$C_{12}$ hydrocarbyl; any $R^2$ is independently selected from $C_1$–$C_4$ alkyl, $C_1$–$C_4$ hydroxyalkyl and benzyl; $R^3$ is selected from the group consisting of $C_1$–$C_{10}$ hydrocarbyl, $R^5NH$, $R^5NR^6$ and $R^5O$ wherein $R^5$ when present, is $C_1$–$C_{10}$ hydrocarbyl; and $R^6$, when present, is $C_1$–$C_4$ hydrocarbyl; $R^4$ is

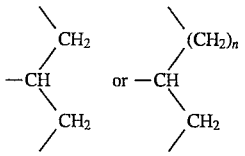

wherein n is from 1 to 4; and $Z^-$ is a charge-balancing water soluble nonsoap anion.

2. A detergent composition according to claim 1 having the form of an automatic dishwashing detergent; wherein said monopersulfate salt is $2KHSO_5 \cdot KHSO_4 \cdot K_2SO_4$; said hydrogen peroxide releasing salt is selected from the group consisting of sodium perborate, sodium percarbonate and mixtures thereof; and said cationic bleach activator is tricationic bleach activator having the formula:

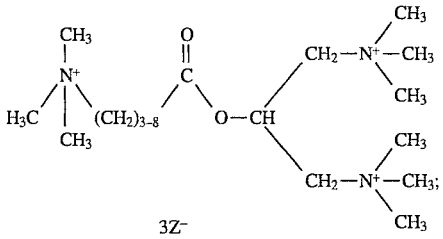

wherein $Z^-$ is a water soluble nonsoap anion.

3. A detergent composition according to claim 2 wherein said monopersulfate salt is present at a level of no more than about 4.9% by weight of the composition.

4. A detergent composition according to claim 1 wherein said hydrogen peroxide releasing salt and said monopersulfate salt ire at a ratio, on an available oxygen basis, of from about 25:1 to about 1:2.

5. A detergent composition according to claim 4 wherein said hydrogen peroxide releasing salt and said monopersulfate salt are at a ratio, on an available oxygen basis, of from about 10:1 to about 1.5:1.

6. A detergent composition according to claim 1 having granular form; said detergent composition further comprising one or more automatic dishwashing detergent adjunct materials being selected from the group consisting of low-foaming nonionic surfactants, carotenoid stain remover and mixtures thereof; said automatic dishwashing adjunct material being selected such that the composition produces less than 2 inches of suds when dissolved in water in a domestic automatic dishwasher at a concentration of from about 0.2% to about 0.4% by weight.

7. A detergent composition according to claim 6 comprising, as part or all of the automatic dishwashing adjunct material, one or more low-foaming nonionic surfactants.

8. A detergent composition according to claim 7 wherein said low-foaming nonionic surfactant is incorporated into said composition at least partially as a coating upon said cationic bleach activator.

9. A detergent composition according to claim 1 wherein: Z is a compatible anion having charge z-selected from the group consisting of bromide, chloride, phosphates, isethionate, carboxylates, polycarboxylates, methanesulfonate, ethanesulfonate, benzenesulfonate, p-toluenesulfonate, cumenesulfonate, xylenesulfonate, naphthalene sulfonate, methyl sulfate, octyl sulfate, and mixtures thereof.

10. A detergent composition according to claim 1 further comprising: from about 0.001% to about 1% by weight of a transition metal bleach catalyst selected from Cobalt catalysts and Iron catalysts.

11. A detergent composition according to claim 10 wherein said bleach catalyst is a cobalt (III) complex having the formula:

$$[Co(NH_3)_n(M)_m(B)_b]T_y$$

wherein n is from 4 to 6; M is one or more monodentate ligands other than ammonia; m is from 0 to 2; when b=0, m+n=6; B, when present, is a bidentate ligand; b is from 0 to 1; when b is 1, n+b=5; and T is one or more appropriately selected counteranions present in a number y, where y is an integer from 0 to 3 to obtain a charge-balanced salt; and wherein further said catalyst has a base hydrolysis rate constant of less than $2300\times10^4$ $Mol^{-1}$ $sec^{-1}$ at 25° C.

12. A detergent composition according to claim 1 further comprising a carotenoid stain removal adjunct selected from:

from about 0.001% to about 1.5% by weight of a diacyl peroxide; and from about 0.001% to about 1.5% by weight of a noncharged hydrophobic bleach activator.

13. A detergent composition according to claim 1 having a 0.4% aqueous solution pH of from about 9 to about 11.5 and a free moisture content, as prepared, not greater than about 7%.

14. A compact granular nonphosphate automatic dishwashing detergent composition comprising:

(a) from about 1% to about 4.9%, by weight, of monopersulfate salts selected from the group consisting of $2KHSO_5 \cdot KHSO_4 \cdot K_2SO_4$, potassium monopersulfate, sodium monopersulfate, magnesium monopersulfate, tetraalkylammonium monopersulfate, and mixtures thereof;

(b) from about 3% to about 15%, by weight, of sodium perborate, sodium percarbonate or mixtures thereof, (c) from about 0.5% to about 5%, by weight, of a cationic bleach activator selected from the group consisting of:

(i) monocationic bleach activator having the formula:

$$((CH_3)_3N^+(CH_2)_5C(O)L)\ (Z)^-$$

where L is caprolactam and (ii) tricationic bleach activator having the formula:

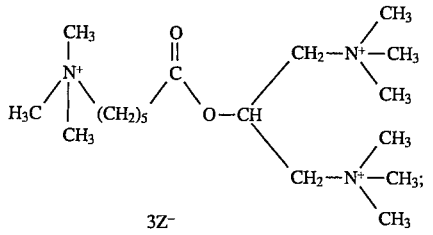

wherein in (i) or (ii) $Z^-$ is a water soluble nonhalogen nonsoap anion;

(d) from 0% to about 1%, by weight, of a Cobalt (III) bleach catalyst;

(e) from about 0.01% to about 0.5% by weight of active detersive enzyme selected from proteolytic enzymes, amyolytic enzymes and mixtures thereof;

(f) from about 0.1% to about 10% by weight of an organic dispersant polymer;

(g) from about 5% to about 25%, by weight, of a pH adjusting agent selected from the group consisting of sodium carbonate, sodium bicarbonate, and mixtures thereof;

(h) from about 4% to about 25%, by weight, of a water-soluble silicate selected from hydrous 2-ratio sodium silicates;

(i) from about 1% to about 80% by weight of citrate builder;

(j) from about 0.1% to about 2% of a chelant;

(k) from about 0.1% to about 10% by weight of a low-foaming nonionic surfactant;

(l) from 0% to about 3% of a carotenoid stain removal adjunct selected from the group consisting of dibenzoyl peroxide and noncharged hydrophobic bleach activators; and (m) from 0% to about 5% of one or more material care adjuncts selected from the group consisting of metasilicate, silicate, bismuth salts, manganese salts, paraffin, triazoles, pyrazoles, thiols, mercaptans, aluminum fatty acid salts, and mixtures thereof.

15. A composition according to claim 14, said composition having a total soluble halide content, expressed as a sum of fluoride, chloride, and bromide, of less than about 0.5% by weight.

16. A composition according to claim 15 wherein said carotenoid stain removal adjunct, (l), is at a level of about 0.1% or greater; and further wherein said carotenoid stain removal adjunct and said low-foaming nonionic surfactant, (k), are individually formulated into different particles.

17. A method for cleansing tableware in an automatic dishwashing machine, comprising a step of washing said tableware with an aqueous bath comprising from about 1,500 ppm to about 4,000 ppm of a detergent composition according to claim 1.

18. A method according to claim 17 in which the tableware is contacted with an aqueous bath comprising from about 2,000 ppm to about 3,000 ppm of said composition.

19. A soaking detetergent composition for removal of tea or coffee stains from hard surfaces, said composition comprising the composition of claim 1 together with at least one detergent builder.

* * * * *